United States Patent [19]

Allen

[11] Patent Number: 4,676,690

[45] **Date of Patent: * Jun. 30, 1987**

[54] MATERIAL SPREADER SYSTEM

[75] Inventor: J. Dewayne Allen, Paragould, Ark.

[73] Assignee: Allen Engineering Corporation, Paragould, Ark.

[ * ] Notice: The portion of the term of this patent subsequent to Sep. 14, 1999 has been disclaimed.

[21] Appl. No.: 457,732

[22] Filed: Jan. 13, 1983

Related U.S. Application Data

[63] Continuation-in-part of Ser. No. 311,674, Oct. 15, 1981, Pat. No. 4,540,312, which is a continuation-in-part of Ser. No. 170,126, Jul. 18, 1980, Pat. No. 4,349,294, which is a continuation-in-part of Ser. No. 101,545, Dec. 10, 1979, abandoned.

[51] Int. Cl.[4] ..... E01C 19/18

[52] U.S. Cl. ..... 404/110; 222/196; 222/556; 222/626; 404/101; 404/108

[58] Field of Search ..... 404/101, 105, 106, 119, 404/108, 110, 113; 222/608-614, 623-626, 173, 195, 196, 627, 556, 557; 118/108, 207, 305, 323

[56] References Cited

U.S. PATENT DOCUMENTS

| | | | |
|---|---|---|---|
| 1,705,502 | 3/1929 | Schellentrager | 222/626 X |
| 1,746,410 | 2/1930 | Tolman, Jr. | 222/556 |
| 2,318,064 | 5/1943 | Delaney | 222/311 X |
| 2,449,710 | 9/1948 | Miller et al. | 404/101 |
| 2,989,930 | 6/1961 | Flowers | 404/108 X |
| 3,043,201 | 7/1962 | Maxon, Jr. | 404/106 |
| 3,220,322 | 11/1965 | Lewis | 404/114 |
| 3,392,641 | 7/1968 | Kessel | 404/106 X |
| 3,515,313 | 6/1970 | Siems | 222/627 X |
| 3,550,812 | 12/1970 | Brown | 222/160 X |
| 4,095,705 | 6/1978 | Hood | 222/196 X |
| 4,249,327 | 2/1981 | Allen | 404/114 |
| 4,349,294 | 9/1982 | Allen | 404/101 X |
| 4,411,554 | 10/1983 | Gratzfeld | 404/101 X |
| 4,541,750 | 9/1985 | Owens | 404/108 X |

FOREIGN PATENT DOCUMENTS

| | | | |
|---|---|---|---|
| 1104039 | 11/1955 | France | 404/106 |

OTHER PUBLICATIONS

1968 Concrete Construction Magazine article relating to a material spreader system.

*Primary Examiner*—Joseph J. Rolla
*Assistant Examiner*—Kevin P. Shaver
*Attorney, Agent, or Firm*—Cahill, Sutton & Thomas

[57] ABSTRACT

A material spreader system includes an elevated bridge for spanning a section of plastic concrete. A spreader including a hopper having an elongated rectangular slot is translated back and forth across the bridge to dispense a widthwise stream of topping material onto the underlying surface. Vibration generating elements are coupled at spaced apart intervals to the spreader hopper to provide for a uniform flow of topping material to the slot. A flow control device spans the length of the slot to dispense a continuous stream of topping material from the slot. A rotating metering device meters the flow of topping material through the slot. A motor translates the spreader back and forth across the bridge and rotates the rotating metering device as the spreader moves such that sequential translations of the spreader across the bridge followed by sequential translations of the bridge along the length of the plastic surface covers the entire surface with a uniform blanket of topping material.

20 Claims, 43 Drawing Figures

REEL #1
REEL #2
AIR IN
M
V
F
L
200
204
206
210
212
214
216
218
222
224
226
232
234
236
238
240
242
90
110
112
136
138
140
150
152

FIG. 18
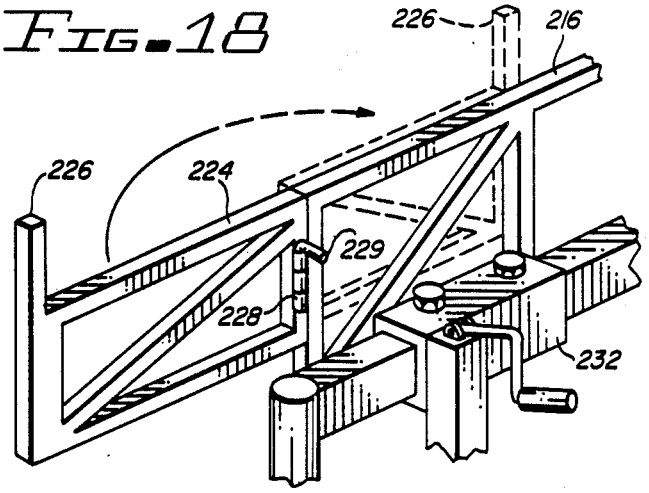
FIG. 19
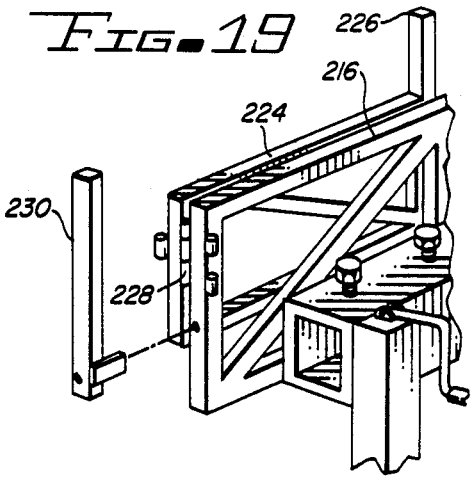
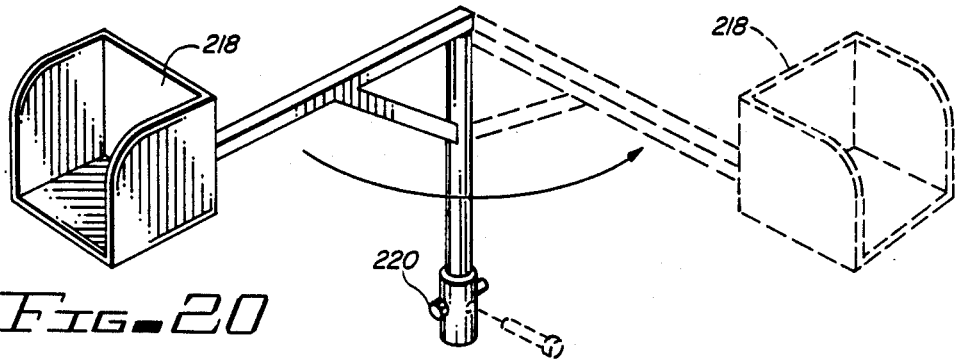
FIG. 20
FIG. 21
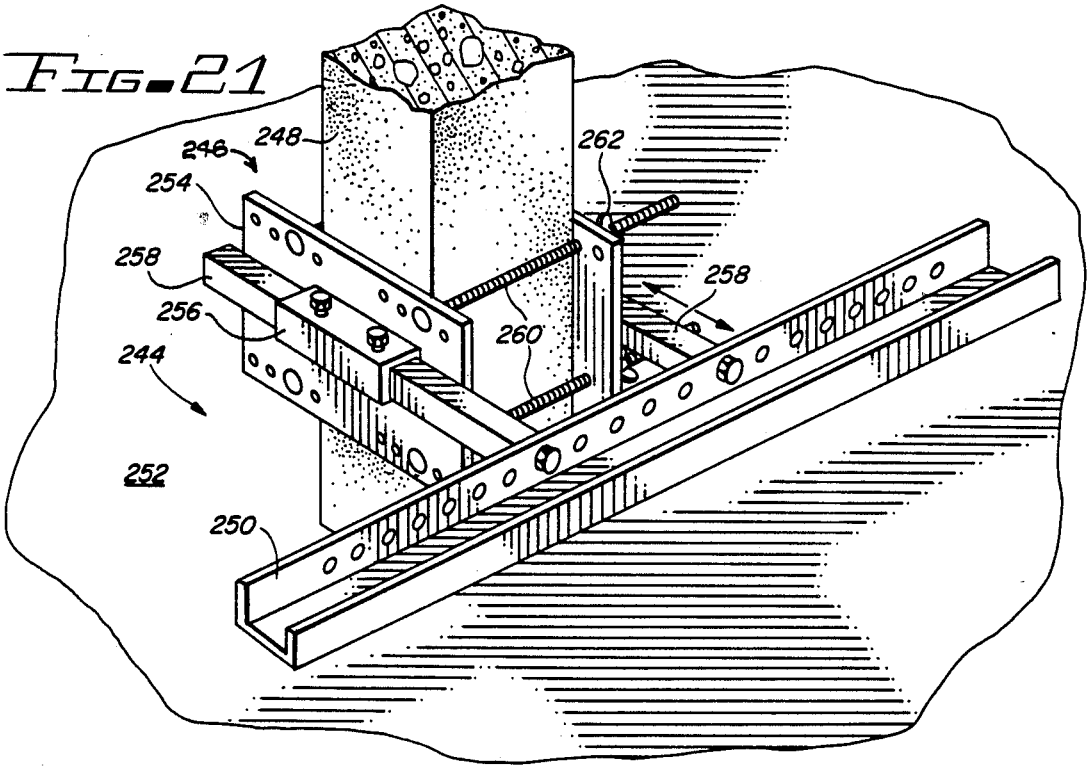

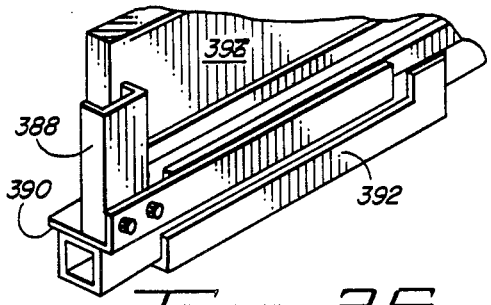
FIG. 26
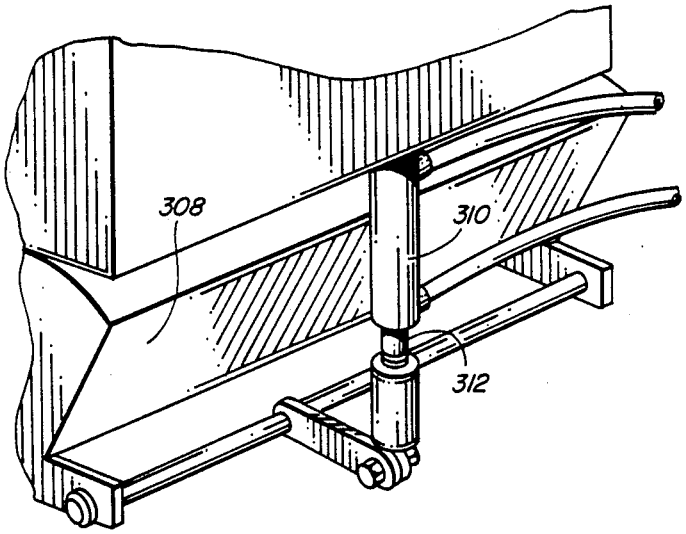
FIG. 24
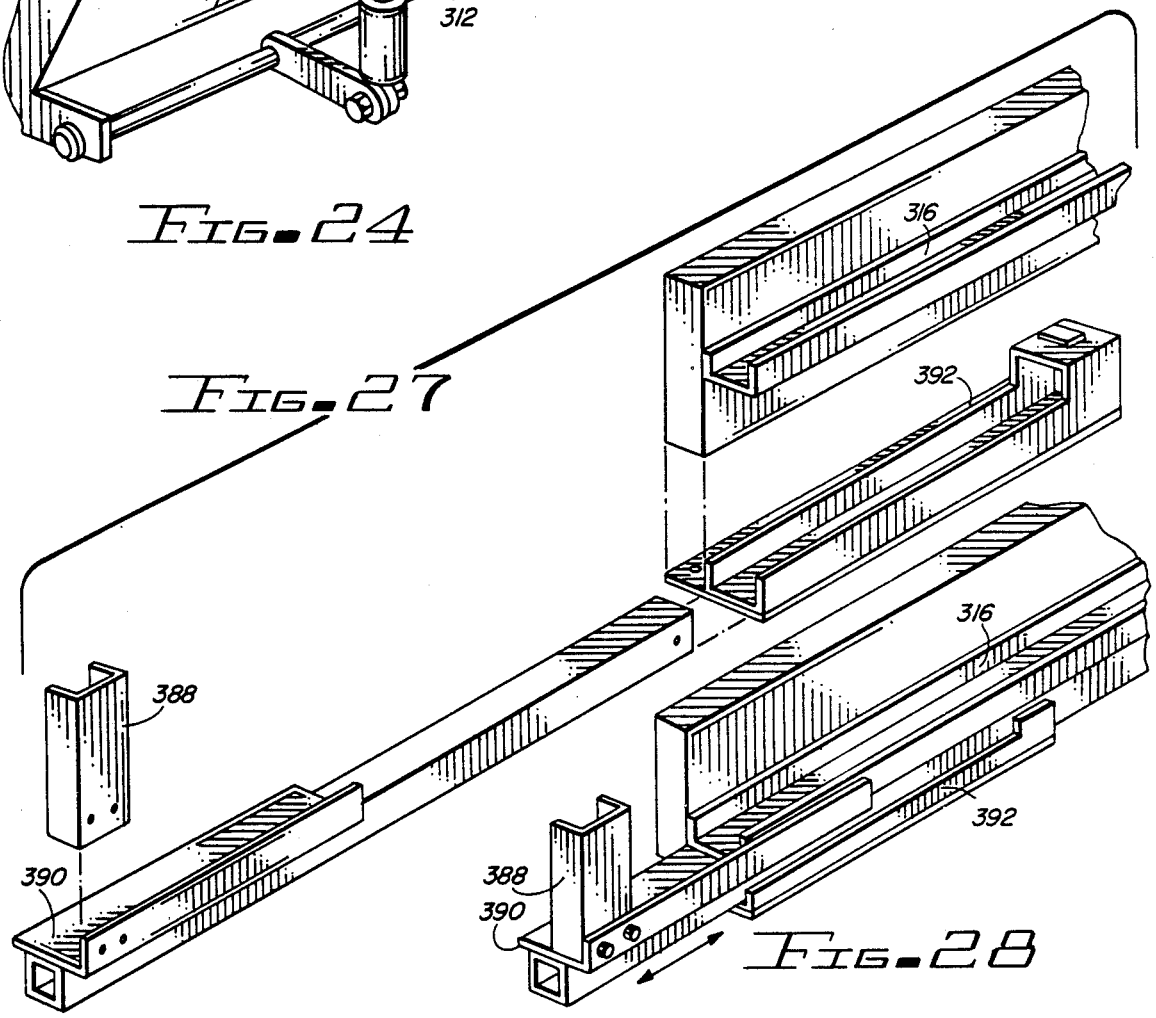
FIG. 27
FIG. 28

MATERIAL SPREADER SYSTEM

BACKGROUND OF THE INVENTION

1. Field of the Invention

The present invention relates to material spreader systems, and more particularly, to systems which include a spreader that is translated above the surface of a plastic material which cannot support the spreader. This application is a continuation-in-part of U.S. patent application Ser. No. 311,674, filed Oct. 15, 1981, now U.S. Pat. No. 4,540,312 which is a continuation-in-part of patent application Ser. No. 170,126, filed July 18, 1980, now U.S. Pat. No. 4,349,294, which is a continuation-in-part of U.S. patent application Ser. No. 101,545, filed Dec. 10, 1979, now abandoned.

2. Description of the Prior Art

A variety of different types of floor hardeners have for many years been applied to the plastic surface of uncured concrete. Metallic aggregate is a very finely divided hardener consisting of iron filings. Mineral aggregate hardener (quartz) consists of particulate minerals similar in size to commercially available lawn and garden fertilizer. Traprock and emery rock are floor hardeners having the largest particulate size. Miscellaneous other materials are occasionally used as floor hardeners. Each of these floor hardeners is comparatively expensive and may typically cost on the order of twenty cents per pound.

Job application specifications relating to floor hardeners typically state the required coverage density in pounds of floor hardener per square foot of floor surface area. Metallic and quartz aggregate floor hardeners are normally mixed with cement and plasticizers, prebagged, and applied by hand using buckets and wheelbarrows to transport the floor hardener around the job site. Traprock and emery rock floor hardeners are usually hauled in bulk to the job site, transported to the immediate vicinity of the job site by a wheelbarrow and spread over the plastic concrete surface with a shovel.

Application of floor hardener materials by hand or with a shovel requires a great deal of skill and is typically possible only on relatively narrow concrete pour widths. Even skilled construction workers cannot achieve a uniform application rate or a high production rate when working with the floor hardener materials described above.

As a result of the uneven distribution achieved by manual application techniques, a significant excess amount of floor hardener must be applied to the plastic concrete surface to assure that the specified minimum application density is achieved. As a result of the high purchase cost of floor hardener materials, it has been well known for many years that a significant cost reduction in both labor and materials could be achieved if floor hardener materials could be distributed at a high rate and with a uniform application density. A reduction of only one-tenth of a pound of floor hardener per square foot of floor area can achieve a significant cost savings and a resulting profit increase, but has been extremely difficult to achieve in practice using prior art techniques.

In the past, a very limited number of contractors have unsuccessively attempted to overcome the shortcomings resulting from manual application of floor hardeners by conducting experiments with domestic lawn spreader equipment. A Scotts lawn spreader having a slotted, manually actuated gate has been used in combination with a dual work bridge or saw horses and a pair of spaced apart planks in an attempt to apply a mineral aggregate floor hardener to a plastic concrete surface. Lawn spreaders were not suitable for use with metallic aggregate since the small size of the iron filing particles were incompatible with the lawn spreader mixing and metering systems. The larger size aggregate particles of traprock and emery rock aggregate wedged between the lawn spreader agitator and hopper and jammed in the slotted gate, rendering the device inoperative. Since mineral aggregate floor hardener was similar in consistency to typical lawn fertilizer, only that specific type of floor hardener could be made to function on a rudimentary basis and on very limited pour widths with the Scotts lawn spreader. Because the mineral aggregrate particles were dispensed through the spaced apart, slotted apertures in the lower portion of the lawn spreader hopper, the floor hardener material was distributed in spaced apart rivulets, rather than the desired uniform particulate blanket. Numerous difficulties were encountered with steering and manually propelling the two wheel lawn spreader device along the dual work bridge or wooden planks.

These sporadic efforts to distribute even mineral aggregate floor hardeners with a lawn spreader were considered unsatisfactory and were never adopted by the industry.

The prior art includes a variety of different types of material spreaders. U.S. Pat. Nos. 2,806,435 (Mundell) discloses a suspended refuse spreader which includes a hopper translatable along the length of a pair of fixed, overhead rails. The hopper of this spreader hangs below these fixed support rails and includes a plow-like deflector which deflects the refuse into two spaced apart piles as the spreader is translated along the rails. A cable is attached to one end of the spreader to translate the spreader with respect to the supporting rails.

U.S. Pat. No. 2,807,234 (Midelen) discloses an engine-driven livestock feeding apparatus which can be translated along a pair of fixed rails between which a livestock feed trough is positioned. The material discharged from the lower portion of this apparatus is separated by a deflector within the trough into two heaps so that cattle on both sides of the rail system can be fed.

U.S. Pat. No. 1,200,393 (Neller) discloses an overhead carrier which is translated along a single fixed overhead rail. When the carrier reaches the desired unloading position, the hopper of the carrier is tilted sideways to discharge the contents.

U.S. Pat. No. 3,230,845 (Mauldin) discloses a spreader which rolls over and is supported by the surface upon which material is to be spread. U.S. Pat. No. 3,453,988 (Trent) discloses a portable spreader which is linearly translatable along the length of a pair of fixed rails.

U.S. Pat. No. 2,113,503 (Belkesley) discloses a multiple-purpose spreader which includes a hopper supported by a grouping of three wheels. This topping spreader rolls over the area upon which material is to be discharged.

U.S. Pat. No. 2,318,064 (Delaney) discloses a conventional fertilizer spreader which includes a hopper and a finger agitator rotated by the spreader wheels. A mechanically actuated gate is positioned in the lower portion of the hopper and meters the discharge of material from the spreader.

A wide variety of other types of relevant prior art has been cited in each of the related patent applications identified above in the section entitled "Field of the Invention."

SUMMARY OF THE INVENTION

Briefly stated, and in accord with one embodiment of the invention, a material spreader system dispenses a topping material onto the surface of a plastic substance lying within an area having a length, width and opposing sides. The area may include a vertically extending obstruction positioned adjacent one of the sides of the area and extending a predetermined distance into the area. The presence of the obstruction within the area defines a reduced width section of the area. The material spreader system includes a spreader having a hopper for storing a supply of topping material and for dispensing a layer of the topping material as the spreader is translated along a path. Bridge means having first and second ends provides an elevated path to permit widthwise translation of the spreader across the area. Means is coupled to the hopper for metering the discharge of topping material from a widthwise slot in the hopper at a rate proportional to the translation velocity of the spreader and independent of the vertical spacing between the spreader and the plastic surface. The metering means includes means for agitating the topping material within the hopper. In one embodiment of the invention, the spreader includes a hydraulic pump for providing a source of pressurized hydraulic fluid and means for energizing the pump. A first hydraulic motor translates the spreader back and forth across the bridge means. Various other hydraulic motors, valves and other elements may be provided to operate or control various other features of the invention. In another embodiment of the invention, the bridge means may include means for varying the length of the bridge means to enable the bridge means to clear the obstruction as said bridge means is translated past the reduced width section of the area. In addition, the bridge means may include means for varying the vertical separation between the bridge means and the surface of the plastic substance.

DESCRIPTION OF THE DRAWINGS

The invention is pointed out with particularity in the appended claims. However, other objects and advantages together with the operation of the invention may be better understood by reference to the following detailed description taken in conjunction with the following illustrations wherein:

FIG. 6A illustrates the gate in the closed position while FIG. 6B illustrates the gate in the open position.

FIGS. 18 and 19 illustrate the structure and operation of the pivotable gate sections of the bridge.

FIG. 20 illustrates the manner in which the control station for the spreader is operated to clear a vertically oriented obstruction.

FIG. 21 illustrates the manner in which a clamp assembly is coupled to a vertically oriented obstruction and to a horizontally oriented track.

FIG. 24 is a partial perspective view of the hydraulically powered spreader, particularly illustrating the hydraulic gate actuator mechanism.

FIG. 26 is a partically cutaway perspective view of the length adjustment means for one span or track of the material spreader system bridge.

FIG. 27 is an exploded perspective view of the length adjustment means depicted in FIG. 26.

FIG. 28 is a partially cutaway perspective view of the length adjustment means depicted in FIG. 26, showing the length adjustment means in a partially extended position.

DETAILED DESCRIPTION OF THE INVENTION

In order to better illustrate the advantages of the invention and its contributions to the art, the various mechanical features of the preferred embodiment of the invention will now be reviewed in detail.

Figure 1:
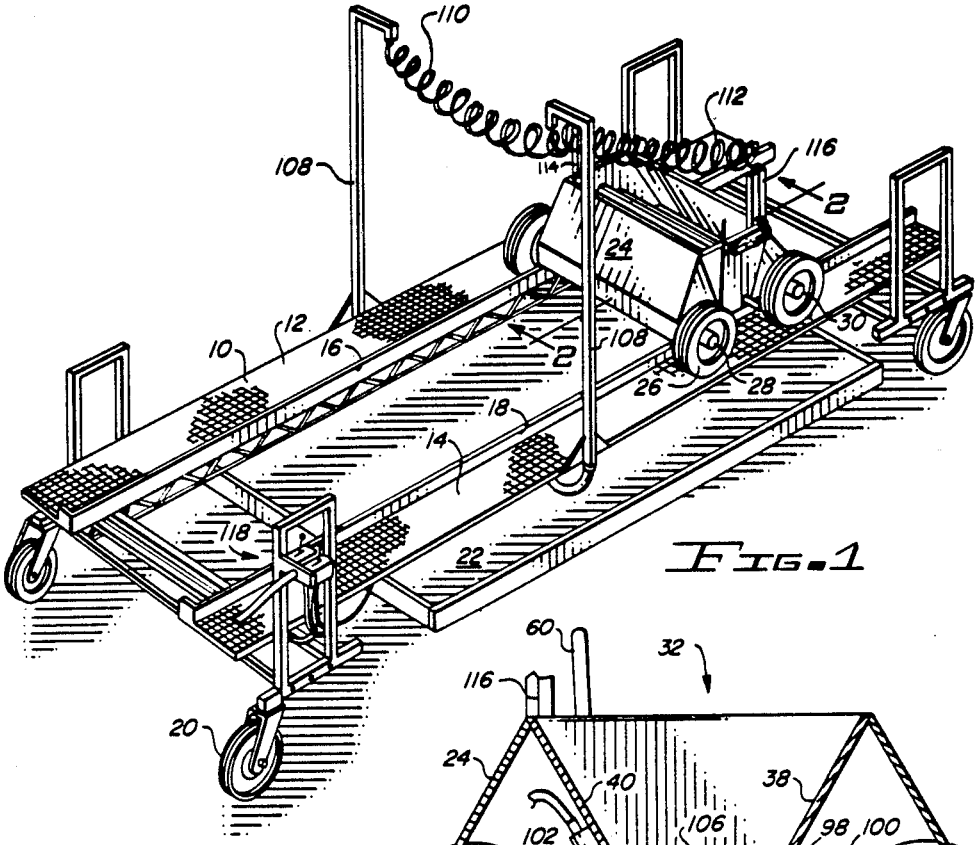
FIG. 1 is a perspective view of the concrete topping spreader system of the present invention.

Referring now to FIG. 1, a multi-section, variable length bridge 10 includes parallel bridge spans 12 and 14. Vertically oriented guide means in the form of guide rails 16 and 18 extend along the interior edges of bridge spans 12 and 14. Bridge 10 is supported by a plurality of wheels 20 which are of a fully castering design to facilitate movement and positioning of bridge 10. Bridge 10 is fabricated in sections generally five to ten feet long. A short single section bridge length is illustrated in FIG. 1, but multiple bridge sections can be readily coupled together to form an overall bridge length of sixty-five feet or longer. Bridge 10 is positioned over the non-load bearing, plastic upper surface of an area of wet concrete 22. Wheels 20 of bridge 10 are supported either on solid ground, a solid previously cured concrete surface, or any other firm, load supporting surface that form a perimeter outside the plastic concrete surface area 22.

Referring now generally to FIGS. 1-5, spreader 24 includes four wheels with rubber pneumatic tires which serve as spreader to bridge coupling means. Wheels 26 are rotatably coupled to spreader 24 by axles 28 and 30 and serve to transfer the weight of spreader 24 to bridge 10. Spreader 24 includes a hopper 32 having first and second side surfaces 34 and 36 and first and second end surfaces 38 and 40. End surfaces 38 and 40 are inclined with respect to the vertical axis of spreader 24 and the lower ends of these end surfaces converge to form an elongated, rectangular or widthwise slot 42 having a pair of opposing long sides and a pair of opposing short sides.

Figure 2:
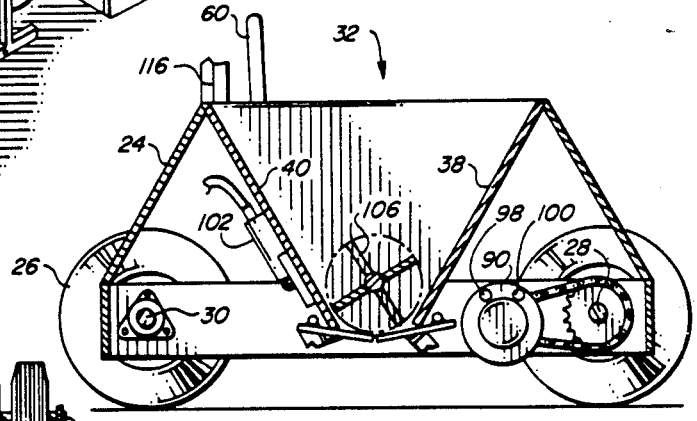
FIG. 2 is a sectional view of the spreader illustrated in FIG. 1, taken along section line 2—2.

First and second end surfaces 38 and 40 include parallel oriented lower edges as depicted in FIG. 2 which define first and second opposing sides of slot 42. Side surfaces 34 and 36 are rigidly coupled to end surfaces 38 and 40 and include parallel-oriented lower edges which define third and fourth opposing sides of slot 42 such that all four sides of slot 42 lie within a single plane. Because hopper 32 is rigidly interconnected with spreader 24 as depicted in FIGS. 1 and 2, relative tilting between hopper walls 34, 36, 38 and 40 and spreader 24 is prevented.

As illustrated in FIG. 1, spreader to bridge coupling means in the form of wheels 26 engage guide rails 16 and 18 at first and second spaced apart intervals along the length of bridge 10. Because guide rails 16 and 18 define parallel, linear paths along the length of bridge 10 and because the left and right sets of spreader wheels 26 are configured to engage the vertically oriented surfaces of guide rails 16 and 18, the spreader to the bridge coupling means or wheels 26 function to steer spreader 24 in a straight line as the spreader is translated back and forth along bridge 10. Although prior art two wheel spreaders freely rotate about their axially aligned wheels, the spreader to bridge coupling means of the present invention engages bridge 10 at first and second spaced apart intervals along the length of the bridge span to maintain a fixed planar relationship between spreader 24 and the bridge. This feature of the invention thereby maintains a fixed planar relationship between spreader 24 and the concrete surface 22 to provide a highly stable platform for distributing topping material from widthwise slot 42.

Figure 5:
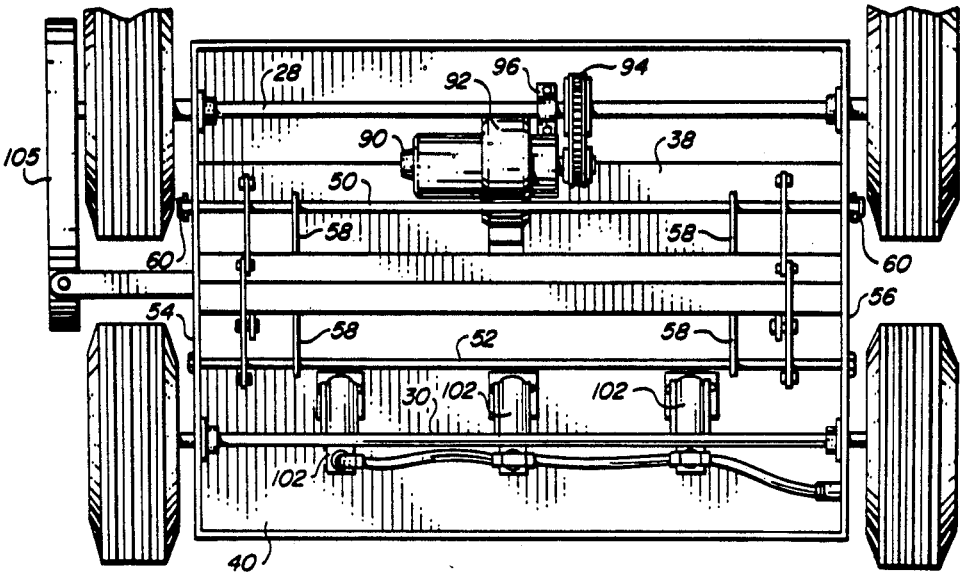
FIG. 5 is a view from below of the spreader illustrated in FIG. 1.
Figure 6A:
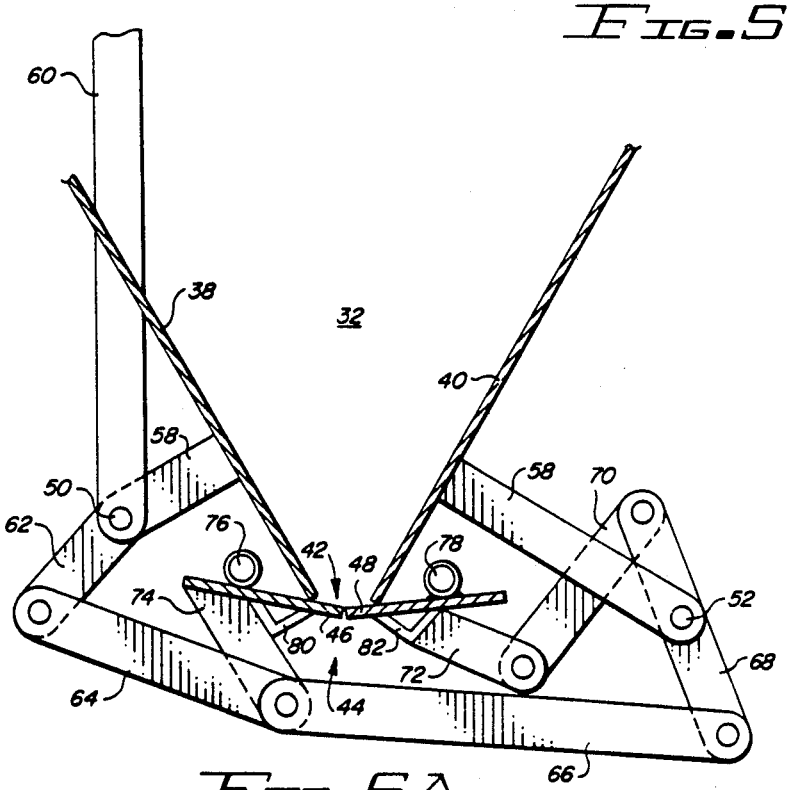
FIGS. 6A and 6B illustrate the spreader gate and linkage which is coupled to the lower portion of the hopper.
Figure 6B:
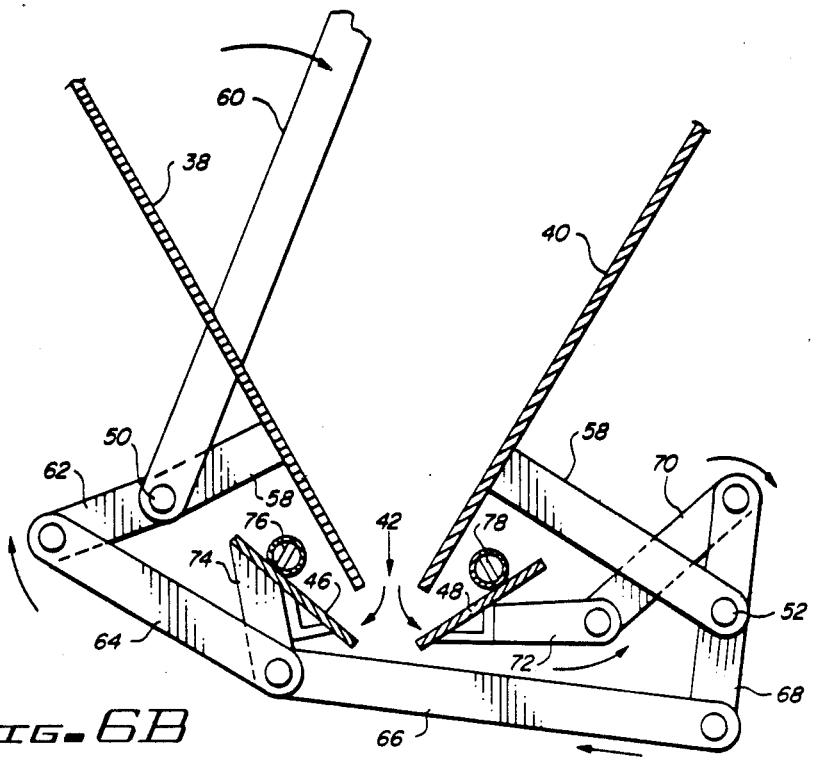

Referring now also to FIGS. 6A and 6B, a gate 44 includes clam shell doors 46 and 48. The linkage which actuates clam shell doors 46 and 48 will be discussed in detail by referring to FIGS. 5, 6A and 6B. Rods 50 and 52 extend through the lower sidewalls 54 and 56 of spreader 24. Rods 50 and 52 are freely rotatable with respect to sidewalls 54 and 56. A group of four standoffs 58 are rigidly mounted to end surfaces 38 and 40 of hopper 32. Rods 50 and 52 are freely rotatable with respect to standoffs 58. On each side of spreader 24, a gate actuator arm 60 is rigidly coupled to rod 50 and extends vertically upward. Rotational displacement of arm 60 causes rod 50 to rotate and thereby rotationally displaces linkage elements 62, 64, 66, 68 70, 72 and 74 as is illustrated in FIGS. 6A and 6B. Clam shell doors 46 and 48 are rotatably coupled to sidewalls 54 and 56 of spreader 24 by rods 76 and 78. Reinforcing elements 80 and 82 are coupled to the lower surfaces of clam shell gates 46 and 48 to provide additional strength and rigidity.

Figure 3:
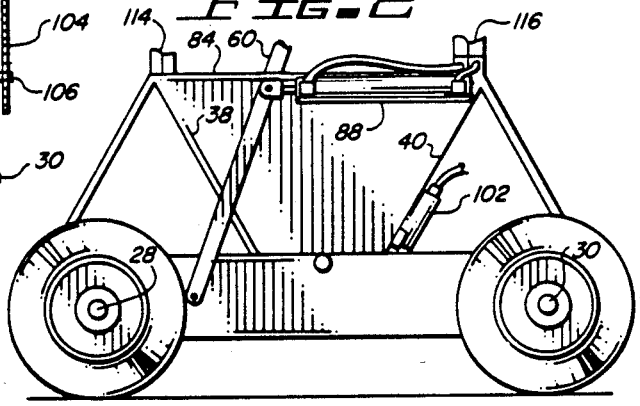
FIG. 3 is a side view, taken from the left-hand side of the spreader illustrated in FIG. 1.

A flange 84 extends horizontally outward from the upper side surfaces of spreader 24 and an actuator arm 60 extends vertically upward through slot 86 in flange 84. Actuator arm 60 is in a vertical position when gate 44 is closed over slot 42. In this closed position, actuator arm 60 contacts and is stopped by the end of slot 86. A clamp can be positioned at a predetermined distance along the length of slot 86 in an arrangement which prevents further movement of actuator arm 60 along the length of slot 86. Clamps can thus be applied to flanges 84 to limit the maximum open position of gate 44. FIG. 3 best illustrates the manner in which pneumatic actuator 88 includes a cylinder which is secured to the side of spreader 24. An actuator arm of actuator 88 is coupled to gate actuator arm 60.

Referring now to FIGS. 2 and 5, a 1.3 horsepower, sixty PSI high torque pneumatic motor 90 is coupled to end member 38 of hopper 32 by a mounting bracket 92. Motor 90 is commerically available from the Gast Manufacturing Company of Benton Harbor, Michigan (model number 4AM-RV-75-GR20). Sprocket wheels on the outputs drive shaft of motor 90 and on axle 28 provide a ten to one gear reduction and are coupled together by a drive chain 94. An additional bearing block 96 is coupled to an inner surface of the housing of spreader 24 to more rigidly support axle 28 in the vicinity of motor 90. Motor 90 can be operated in either a forward or a reverse direction depending on whether pressurized air is coupled to port 98 or port 100.

A plurality of three pneumatic air vibrators 102 is coupled to end member 40 of hopper 32 as is best illustrated in FIG. 5. When pressurized air is supplied to the input ports of each of these air vibrators, a weighted piston within the cylinder of each device vibrates up and down along the vertical axis of the device. This piston reciprocates at a rate of ten thousand cycles per minute. Pneumatic air vibrators of this type are commercially available from the Navco Manufacturing Company. Note that each of these vibrators is positioned near the lowermost portion of hopper 32 and that these vibrators are separated by a uniform spacing along the width of hopper 32. Air vibrators 102 commence operation when actuator 88 is operated to open gate 44. The vibrations produced by air vibrators 102 causes the topping material within hopper 32 to be uniformly metered from gate 44 and prevents undesired particle build-ups in hopper 32.

Figure 4:
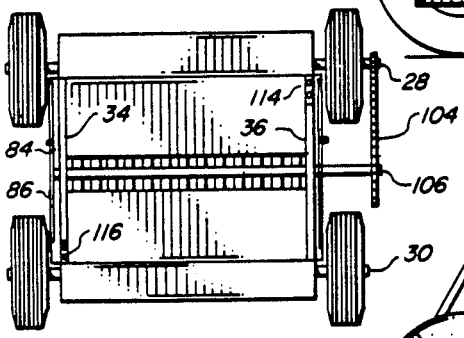
FIG. 4 is a view from above of the spreader illustrated in FIG. 1.

Referring now to FIGS. 4 and 5, a chain 104 surrounds a pair of sprocket wheels which are coupled to the shaft of finger agitator 106 and to axle 28. A chain guard 105 is positioned around chain 104 and serves as a protective device. Since wheels 26 are rigidly coupled to axle 28, the linear translation of spreader 24 along bridge 10 rotates wheels 26 and rotates vaned metering means or finger agitator 106 at a rate directly proportional to the rate of translation of spreader 24. Vaned metering means 106 includes a shaft having a centrally located axis of rotation and a plurality of vanes coupled to the shaft at radically spaced apart intervals as depicted in FIGS. 2 and 4. Faster movement of spreader 24 causes more rapid rotation of finger agitator 106 and a more rapid rate of discharge of topping material from gate 44 when it is in the open or partially open position. Thus, a uniform topping discharge density is provided which is not affected by the rate of translation of spreader 24.

Referring now to FIGS. 1–3, a pair of support arms 108 extend vertically upward from the midsection of bridge 10. A pair of coiled, flexible double passageway air hoses 110 and 112 extend from support arms 108 to support arms 114 and 116 on spreader 24. Double passageway air hoses 110 and 112 are routed through support arms 108 to control station 118 on bridge 10. A source of pressurized air (about 60 PSI, 25 C.F.M.) is coupled to control station 118.

The pressurized air coupled to support arm 116 operates actuator 88 and pneumatic vibrators 102. The pressurized air supplied to spreader 24 through support arm 114 is coupled to input ports 98 and 100 of motor 90. One of the two valves in control station 118 controls the air pressure directed to actuator 88 and air vibrators 102 while the second control valve regulates the amount and direction of air coupled to motor 90. This second control valve permits motor 90 to be operated in either forward or reverse directions to regulate the direction of travel of spreader 24. Varying the amount of air pressure transmitted to motor 90 can vary the velocity of spreader 24 from a low translation speed of about twenty feet per minute to a high translation speed of about one hundred feet per minute.

The manner of operating and using the concrete topping spreader of the present invention will now be described in some detail. Generally, a three man crew is required to operate the topping spreader in the most efficient manner. One crew member is primarily responsible for reloading the hopper with the desired topping material. One man operates the control station to regulate the direction and speed of operation of the spreader across bridge 10. The third man assists in laterally translating bridge 10 along a length of a section of concrete over which the topping material is to be distributed. Many different topping materials such as quartz, mineral, metallic, traprock, and emery can be accurately dispensed by the present system.

The desired rate of distribution of topping material is first determined and a clamp or other similar device is positioned along slot 86 of flanges 84. This determines the maximum open position of clam shell gate 44. With typically used topping material, the rate of distribution can be varied from about one-tenth of a pound of topping material per square foot to about four pounds per square foot. After the hopper of spreader 24 has been loaded, the operator opens both control valves at control station 118. Actuator 88 is thereby actuated to the open position and motor 90 commences rotation. Rotation of motor 90 causes axle 28 to rotate which rotates chain 104 and thus finger agitator 106. The extreme outer edges of finger agitator 106 are positioned within about one-eighth of an inch of side surfaces 38 and 40 of hopper 32 and serve to wipe away any topping material which may have formed an obstruction or bridge and, in addition, insures a free and uniform flow of topping material through clam shell gate 44 at all times. Air vibrators 102 commence operation when actuator 88 causes gate 44 to open.

After spreader 24 has completely traversed the widthwise span of bridge 10 across concrete surface 22, the spreader is stopped, the bridge is laterally translated a distance equal to the width of topping material previously spread and the spreader is translated over the bridge 10 in the opposite direction. This procedure is repeated with intervening reloading steps until the complete surface of the wet concrete has received a layer of topping.

Referring now to FIGS. 7–12, a modified version of the concrete topping spreader will now be described in detail. This modified spreader embodiment illustrated in FIGS. 7–12 will be referred to as spreader 124.

Figures 7, 8:
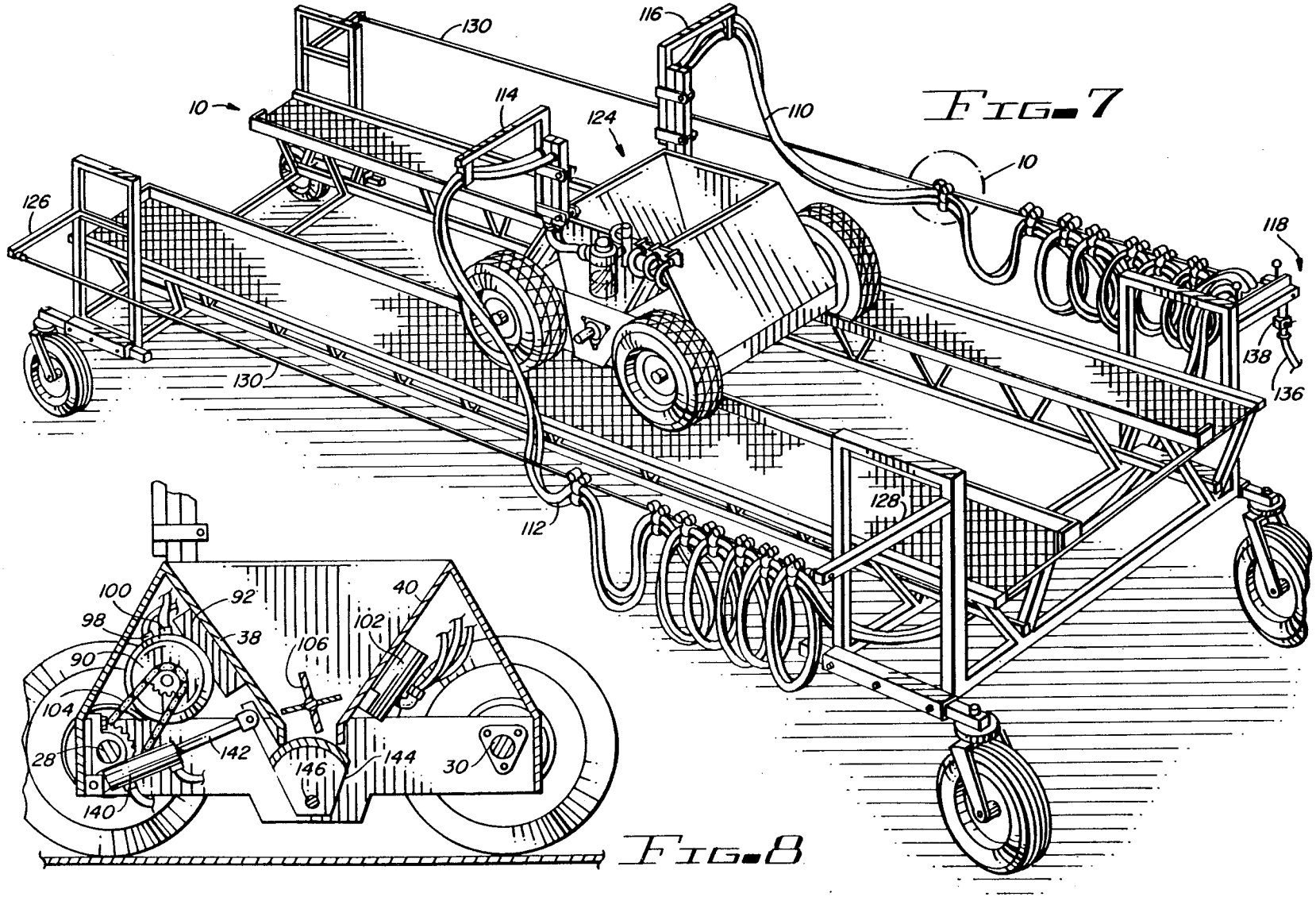
FIG. 7 illustrates a second embodiment of the concrete topping spreader of the present invention which includes a modified lateral support structure for the air supply hose assemblies and a modified spreader gate.
FIG. 8 is a sectional view of the spreader illustrated in FIG. 7.

As was the case with bridge 10 depicted in FIG. 1, the multi-section, variable length bridge 10 depicted in FIG. 7 incorporates triangular truss bridge spans 12 and 14 each having a load bearing base for supporting wheels 26 of spreader 124. Each bridge span includes an apex element which in the illustrated embodiment of the invention is positioned below and centered about the span base. The apex element is oriented parallel to the span base. A plurality of spaced apart struts extend between the spaced apart edges of the span base and the apex element to thereby define the sides of the triangular truss bridge span. The triangular truss configuration of bridge spans 12 and 14 provides a rigid, yet light weight bridge 10 which can be fabricated in five foot and ten foot sections as described above and assembled in the field into a desired length of up to at least sixty-five feet as dictated by the width of the area of plastic concrete 22. When the spreading job has been completed, the bridge spans 12 and 14 of variable length bridge 10 can be broken down into shorter sections compatible with the load carrying capability of a pick-up truck or other commonly available, short bed length vehicle.

Figure 10:
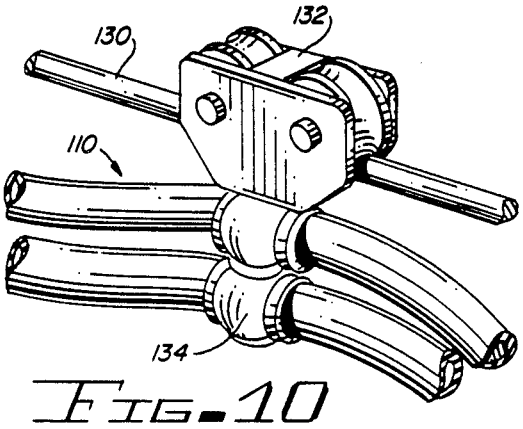
FIG. 10 is an enlarged perspective view of one of the guideblock assemblies illustrated in FIG. 7.

FIG. 7 specifically indicates the manner in which dual air hoses 110 and 112 are coupled between bridge 10 and spreader 124. On each side of bridge 10, a pair of outriggers 126 and 128 extend laterally outward and are coupled together by a tightly stretched support cable 130. FIG. 10 specifically indicates that a plurality of laterally translatable guideblocks 132 are coupled at evenly spaced apart intervals to air hose 110. As illustrated in FIG. 10, a clamp 134 is coupled to the lower portion of guideblock 132 and includes a pair of cylindrical apertures through which each individual air hose of the dual air hose assembly 110 can be routed. The free end of air hose 110 is coupled to spreader 124 by support 116. The guideblocks are laterally translated back and forth across bridge 10. Air hose 112 is coupled to bridge 10 in a similar manner.

Figure 12:
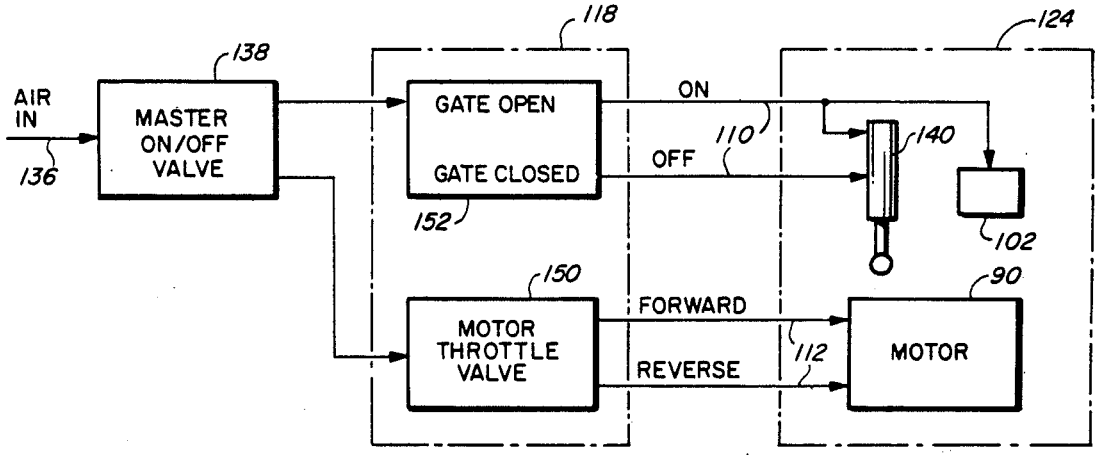
FIG. 12 is a schematic diagram of the pneumatic control and power system for the concrete topping spreader.

Both air hoses 110 and 112 are coupled to a control panel 118. FIGS. 7 and 12 indicate that an air input hose 136 is coupled to master on/off valve 138. Pneumatic valve 150 is coupled to control assembly 118 and air hose 112 and serves as a motor throttle valve. Actuating valve 150 to provide pressurized air to one of the two hoses of hose assembly 112 causes motor 90 to rotate in a forward direction. Controlling the rate of air flow through valve 150 varies the operating speed of motor 90. When pressurized air is coupled by valve 150 to the second air hose of air hose assembly 112, motor 90 rotates in a reverse direction at a rate controlled by the amount of air flow provided.

Figure 9:
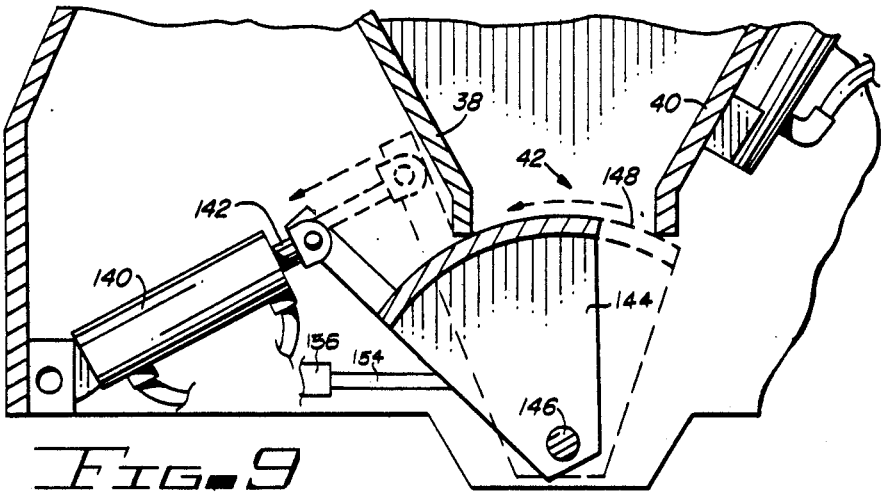
FIG. 9 is a partial sectional view of the spreader illustrated in FIG. 8, illustrating the spreader gate in the "open" and "closed" positions.

Control valve 152 in control unit 118 actuates air vibrators 102 and the two pneumatically controlled gate position control cylinders 140. In the first position, valve 152 directs pressurized air through one of the two air hoses in hose assembly 110, causing the shafts of the two air actuator cylinders 140 to be retracted into the position illustrated in FIG. 9. As indicated in FIG. 9, shaft 142 and pneumatic actuator 140 are coupled to slot engagement means or gate 144 which pivots or rotates about shaft 146 into an open position which establishes a gap indicated by reference number 148 between side surface or first end wall 40 and the smoothly curved cylindrical section which forms the upper surface of gate 144. When control valve 152 is moved into the "off" position, air pressure is removed from the hose which supplies air under pressure to air vibrators 102 and is routed instead to the second air pressure port of actuator cylinders 140. In the "off" position valve 152 directs pressurized air through the second hose of air hose assembly 110 which actuates pneumatic actuator 140 and causes shafts 142 to extend. Extension of shafts 142 rotates gate 144 into the "closed" position and terminates the flow of material through widthwise slot 42 of spreader 124. In FIG. 9, the dotted lines indicate the "closed" position of gate 144.

Figure 11:
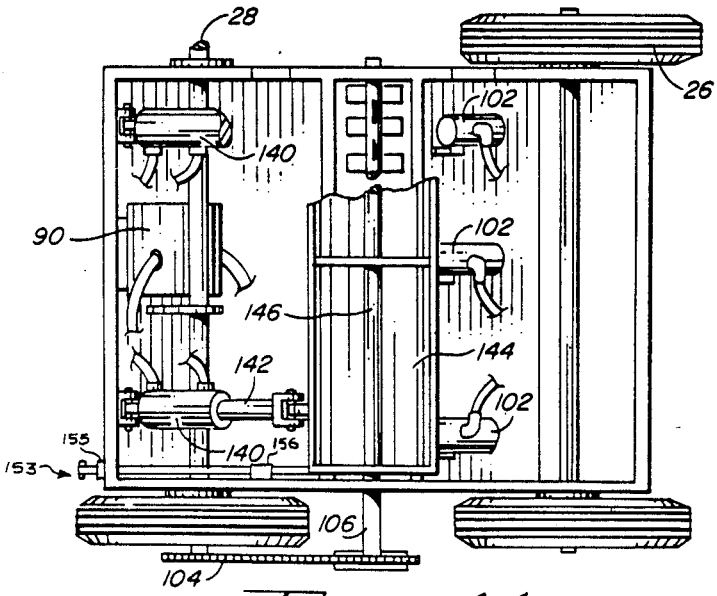
FIG. 11 is a partially cut away view from below of the spreader illustrated in FIG. 8.

Referring now to FIGS. 9 and 11, an adjustable mechanical stop 153 limits the maximum gate displacement into the "open" position to thereby control the rate at which topping is dispensed as spreader 124 is laterally translated. In the preferred embodiment of the present invention, a one inch diameter threaded rod 154 passes through an aperture cut in the lower end wall of the base of spreader 124. A nut 155 is welded to the exterior surface of the base of spreader 124 and causes rotation of rod 154 to displace the end of rod 154 fore and aft with respect to the side of gate 144. A second bolt is welded to the exterior end of rod 154 to permit stop 153 to be readily adjustable by means of a wrench. A hollow tubular support bracket 156 is welded to the interiorside surface of the base of spreader 124. Bracket 156 both supports and guides rod 154 and serves to maintain rod 154 in a fixed vertical position with respect to gate 144.

In order to simplify the drawings, only a portion of stop 153 is illustrated of FIG. 9 and only one of the two stops actually used in the preferred embodiment of the present invention is illustrated in FIG. 11. It should be understood that a second stop is provided on the opposite side of the base of spreader 124 so that the one stop abuts each end of gate 144. Generally it will be desireable to either weld a flat plate to gate 144 at the point at which the end of stop 153 will strike the gate or alternatively to form a notch on the end sections of gate 144 so that each end of stop 153 will strike a surface substantially perpendicular to the end of rod 154.

It is generally desirable to fabricate the inclined end walls 38 and 40 of the spreader at an angle approaching 45°. The vibrations produced by air vibrators 102 cause end wall 40 to form a vibrating feeding surface which prevents the topping material contained within the hopper from adhering to this vibrating surface and insures that the topping will flow downward along end surface 40 smoothly and evenly through the gap 148 formed in widthwise slot 42. Finger agitator 106 also assists in providing a uniform flow of topping through gap 148 by maintaining the topping material in a fluffed or agitated state. This fluffing action provided by finger agitator 106 prevents compaction of the topping material which in many circumstanced would cause an uneven and irregular flow of topping material.

The outer slot engagement surface of slot engagement means 144 is formed in the shape of a section of the wall of a cylinder and rotationally engages the lower surfaces of end walls 38 and 40 which define widthwise slot 42. The unique rotary wiping action of slot engagement means 144 provides a self-cleaning action which prevents topping material from adhering to the leading edge of the slot engagement surface. As slot engagement means or gate 144 is rotationally displaced into the closed position by actuator cylinders 140, the rotating scraping action between the lower edge of end wall 40 and the curved slot engagement surface wipes away topping material from the leading edge of that surface. As depicted in FIG. 8, the curved slot engagement surface is formed in the shape of a section of the wall of a cylindrical surface.

Stop 153 must be adjusted to the desired setting before the spreading operation is commenced. For many standard types of topping material, the two stops are adjusted so that ⅛" gap is established at gap 148 when gate 144 is in the open position. The dimension of gap 148 must always be greater than the diameter of the material to be spread.

Continuously maintaining the self-cleaning lip of gate 144 in a clean condition, the ability to precisely control the dimension of gap 148, the continuous vibration of end wall 40, and the constant translation velocity of spreader 124 enables the present invention to uniformly spread topping material with a distribution accuracy of two to three percent which has previously been unobtainable by any prior art device or technique.

The method of operation of the present invention will now be discussed in detail. First, the hopper is filled with the desired topping material. Motor throttle valve 150 is actuated to propel spreader 124 in the desired direction and at the desired velocity. As the spreader passes above the beginning of the wet concrete surface, control valve 152 is actuated, causing actuator cylinders 140 to snap gate 144 into the desired open position which is determined by stops 153 which have been previously adjusted. In a typical application, stops 153 will be adjusted to provide a ⅛" gap 148. Under normal operation, a single pass of spreader 128 across bridge 10 will distribute topping at the rate of ¼ pound per square foot. If an applica- of one pound per square foot is desired, spreader 12 must make four sequential passes over the same area of wet concrete. The topping is thus distributed in four separate blankets which has been found to produce far superior results than can be attained by a single higher topping distribution rate pass. At the end of the fourth pass, bridge 10 is laterally translated so that spreader 124 can then be translated across the next section of wet concrete four more times. To produce an application rate of 1½ pounds per square foot, six passes of spreader 124 over the wet concrete would be provided.

It will be apparent to those skilled in the art that the concrete spreader system disclosed above may be modified in numerous ways and may assume many embodiments other than the preferred forms specifically set out and described above. For example, a separate wheel could be coupled to the shaft of finger agitator 106 in a manner which would permit it to contact the surface of spans 16 and 18 of bridge 10. In this embodiment, finger agitator 106 rotates at a rate proportional to the spreader translation velocity. Additionally, the spreader may be powered by a gas, electric or hydraulic motor and controlled by a computer or by remote control means receiving radio or optical control signals. Numerous other structural and operational modifications would be readily apparent to one skilled in the art. The concrete topping spreader system of the present invention can be used to spread various types of topping materials over many different types of surfaces and does not require an elevated bridge of the specific type disclosed.

Referring now to FIGS. 13–21, a significantly improved and more sophisticated material spreader system is disclosed. This improved spreader system is designed to dispense a topping material onto the surface of a plastic material such as uncured concrete which is lying within an area having a length, width and opposing sides. At many job sites, the area of plastic material may include a vertically extending obstruction such as a column which penetrates a predetermined distance into the side of the area. Great difficulty has been encountered in efficiently and economically dispensing a topping material over an area which includes a number of vertical obstructions of this type. When using material spreaders of the type disclosed in FIGS. 1–12 above, awkward and difficult techniques such as skewing the bridge deck to spread topping material over plastic concrete lying between a pair of spaced apart columns has proven to be less than satisfactory. Significant amounts of additional time and effort are required to utilize these techniques and to then reposition the spreader/bridge assembly on the opposite side of these vertical obstructions. When vertical obstructions are present on a job site, job completion times and labor expenses are drastically reduced by utilizing the material spreader system illustrated in FIGS. 13–21.

Referring initially to FIGS. 13–16, one embodiment of a material spreader system adapted to dispense a topping material over an area including a vertical obstruction will now be described in detail.

Figures 13, 14, 15:
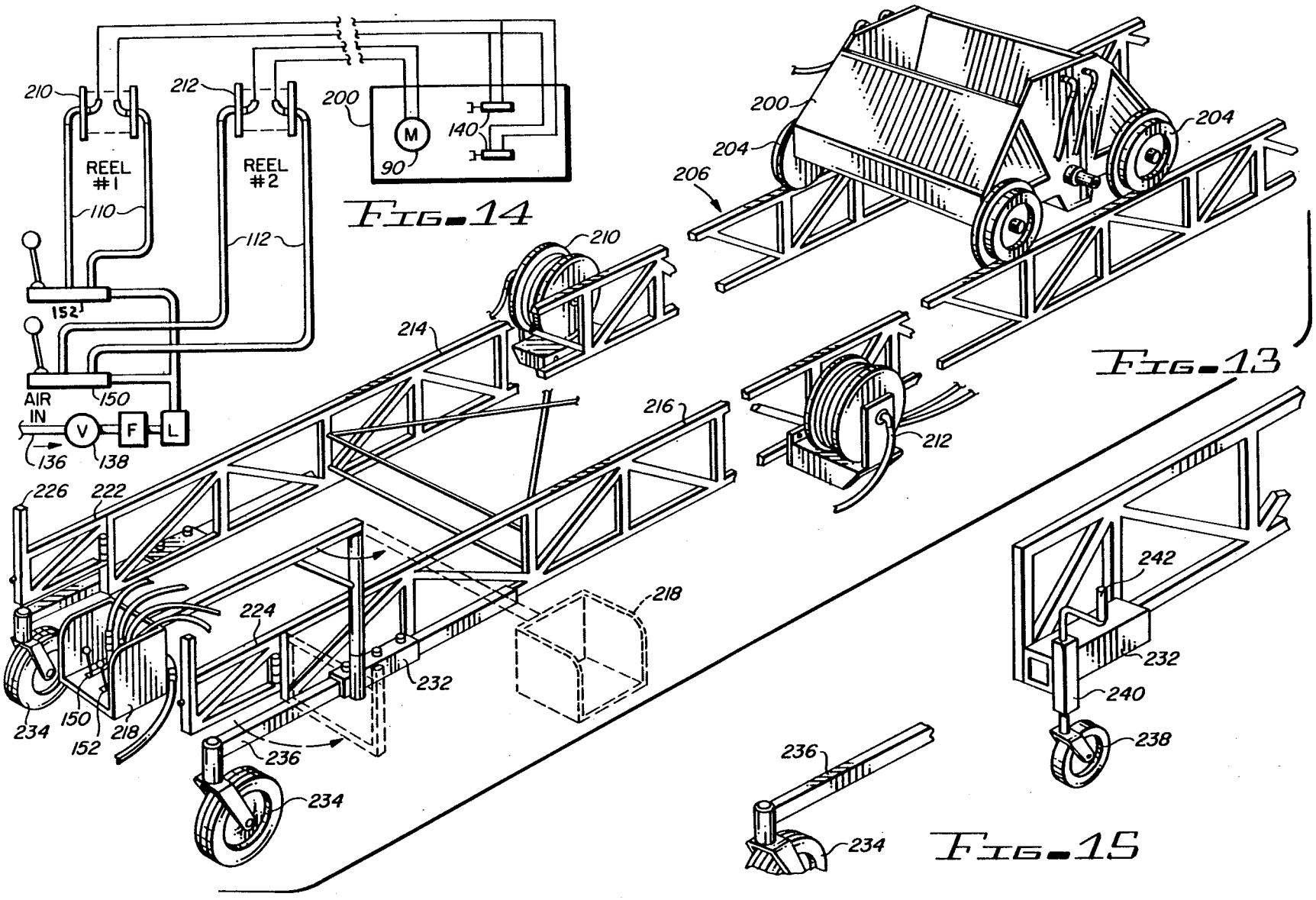
FIG. 13 is a perspective view of an improved material spreader system including adjustable bridge means having means for reducing the span length of the bridge.
FIG. 14 schematically illustrates the configuration of the pneumatic control and power system for the improved material spreader system.
FIG. 15 is a partial perspective view illustrating the manner in which the wheel and wheel mounting bracket of the improved spreader system is coupled to an end of the bridge.
Figure 16:
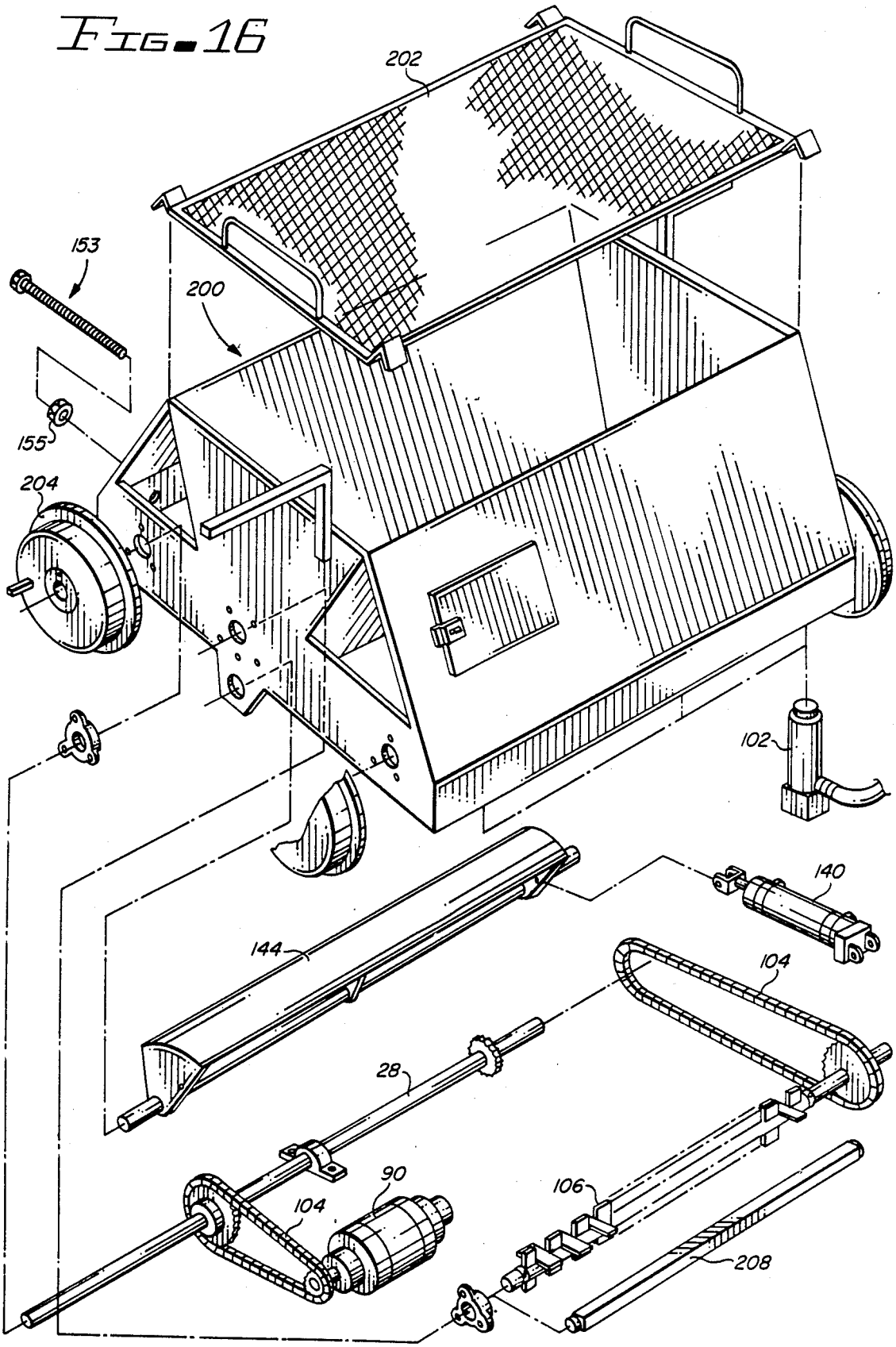
FIG. 16 is an exploded view of the spreader of the improved material spreader system, particularly illustrating the mechanical elements of the spreader.

As is readily apparent from FIG. 16, material spreader 200 is substantially similar in design to material spreader 124 described above and illustrated in FIGS. 7–9 and 11. In FIG. 16, the elements of material spreader 200 have been designated with reference numbers corresponding to reference numbers utilized in connection with the description above of material spreader 124. Material spreader 200 has been provided with a hopper cover 202 which includes an open rectangular grate or screen which assists in separating or breaking up the topping material as the topping material is loaded into the hopper of material spreader 200. In addition, material spreader 200 has been provided with a set of four flanged wheels 204 which couple material spreader 200 to bridge means 206 which is illustrated in FIG. 13. A square tube agitator 208 may be substituted for finger agitator 106 if particularly large size topping material is to be dispensed from the spreader.

FIGS. 13 and 14 illustrate that air hoses 110 and 112 are coupled to take up reels 210 and 212 which are spring biased to minimize slack in the air hoses coupling reels 210 and 212 to spreader 200 as spreader 200 is translated from one end of bridge 206 to the opposite end and back. FIG. 14 illustrates the manner in which spreader 200 is energized and controlled and corresponds to the structure depicted and described in connection with FIG. 12.

Referring now to FIGS. 13, 15, and 18–20, the adjustable bridge means 206 of the present invention will be described in detail. Bridge 206 includes first and second spaced apart spans 214 and 216 which engage the four flanged wheels 204 of spreader 200 and provide an elevated path to permit widthwise translation of spreader 200 across an area of plastic concrete or other surface over which topping material is to be dispensed.

FIGS. 13 and 20 illustrate that control valves 150 and 152 are positioned within a control station 218 which is rotatably coupled to the lower end section of span 216. A locking pin 220 maintains control station 218 in a normal or "extended" position depicted in the left side of FIG. 20 or in the "retracted" or obstruction clearance position depicted in dotted lines in the right side of FIG. 20. Control valves 150 and 152 are operative when control station 218 is in either the extended or retracted position.

Referring now to FIGS. 13, 15, 18 and 19, the span length reducing means of bridge 206 will now be described in detail. Each end of spans 214 and 216 of bridge 206 includes pivotable gate sections 222 and 224, each of which includes a vertically extending stop 226 which prevents spreader 200 from being translated beyond either end of bridge 206. Each side of gate sections 224 and 226 includes a three-element hinge 228 and a removable hinge pin 229 which couples the gate sections to the bridge spans. (See FIG. 18) FIG. 19 illustrates that the outer hinge pin has been removed from gate section 224, permitting that gate section to be swung in a clockwise direction into an inboard retracted position shown. Removal of hinge pin 229 from hinge 228 on the opposite side of gate section 224 permits counterclockwise rotation of that gate section over clamp 232 into an outboard retracted position. Gate section 222 includes identical double hinge structure and can also be pivoted into either an inboard or outboard retracted position.

The vertical dimension of gate sections 222 and 224 is less than the vertical dimension of bridge spans 214 and 216 to provide clearance between these gate sections and other structural elements of the spreader system. An auxiliary stop 230 is bolted to the hinged junction between the gate sections and the bridge spans when the gate sections are in the retracted position illustrated in FIG. 19 since stop 226 will have been laterally displaced from the path of wheels 204 and will no longer provide the required stopping feature to prevent inadvertent damage to the equipment.

The material spreader system of the present invention also includes translatable bridge support means which is best illustrated in FIGS. 13, 15, 18 and 19. A clamp 232 is coupled to the lower end section of both ends of bridge spans 214 and 216 and receives each of a pair of wheels 234 and wheel mounting brackets 236. Each end of bridge 206 includes a pair of clamps 232, wheels 234 and wheel brackets 236 which are collectively referred to as a first support means or a first roller assembly. A first roller assembly supports each of the two ends of bridge means 206 and permits the bridge to be translated along the length of the area over which topping material is to be dispensed. Wheels 234 are fully castering pneumatic tire and wheel assemblies of the type described in connection with the spreader depicted in FIG. 7.

The translatable bridge support means of the present invention further includes second means for supporting an end of bridge means 206 as the bridge means is translated along a reduced width section of the area over which topping material is to be dispensed. In the preferred embodiment of the present invention, this second support means includes a second roller assembly which is coupled to each end of spans 214 and 216 of bridge 206. Each element of the second roller assembly includes a small wheel 238, a vertically oriented screw jack assembly 240 which is coupled to tubular clamp 232, and a jack handle. Screw jack assembly 240 is actuated to elevate wheel 238 above the surface of the plastic concrete over which the material spreader system is translated to permit the first roller assembly to support the bridge as the material spreader system is being laterally translated across the full width section of the area of plastic concrete.

Referring now to FIG. 21, roller support means 244 includes a clamp assembly 246 which is coupled around and securely attached to a vertically oriented obstruction in the form of a column 248. Clamp 246 is fabricated from rectangular plates 254, threaded rods 260 and wingnuts 262. A horizontally oriented channel shaped track 250 is coupled to and supported by clamp assembly 246. Clamp assembly 246 includes telescopic adjustment structure which permits the lateral spacing between track 250 and column 248 to be varied as desired so that track 250 can readily engage wheels 238 of the second roller assembly. This telescopic adjustment structure comprises hollow rectangular tubes 256 to which slide tubes 258 are coupled. The set bolts located in the top of tubes 256 lock slide tubes 258 in the desired position with respect to column 248. Alternatively, structure may be provided to telescopically or otherwise adjust either the length of spans 214 and 216 or the relative lateral position of screw jack assembly 240 with respect to spans 214 and 216. The telescopic adjustment feature accommodates either difference in the lateral spacing between pairs of spaced apart columns 248 at a particular job site or accommodates different lateral spacings encountered at various different job sites.

Figure 17A:
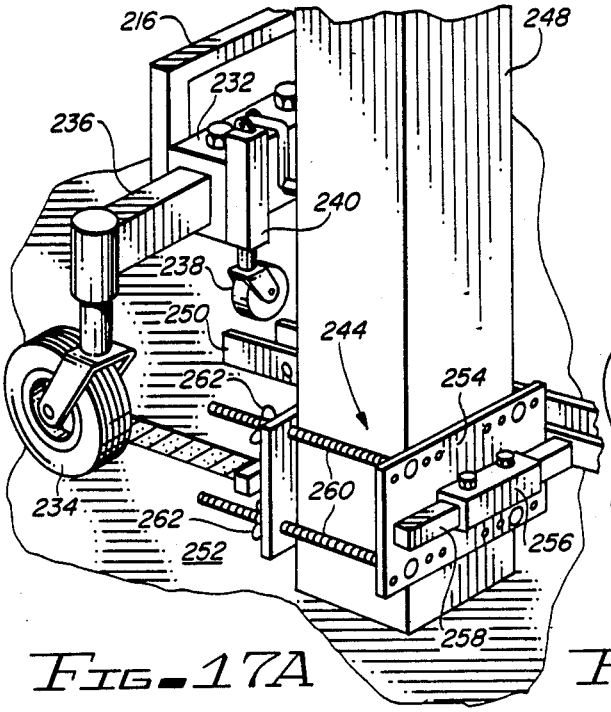
FIGS. 17A–D represent a partially cutaway perspective view of the improved material spreader system, particularly depicting the method in which the configuration of the bridge is modified to permit the bridge to be translated past a vertically oriented obstruction.

The manner in which the material spreader system is utilized to spread a uniform layer of topping material over an area including full width and reduced width sections of the type described above will now be described in detail primarily by reference to FIGS. 13 and 17A–D. FIG. 13 and FIG. 17A depict the configuration of the material spreader system which is typically utilized to support the material spreader in an elevated position above an area of plastic concrete. Wheel mounting brackets 236 are coupled to bridge spans 214 and 216 and extend outward a length sufficient to permit wheels 234 to contact an underlying supporting surface 252 adjacent to, but outside of the area of, plastic concrete. Wheels 238 are elevated above the surface of plastic concrete so that the entire bridge assembly is supported by and laterally translated by wheels 234. When a vertical obstruction such as column 248 is approached, clamp assembly 246 together with track 250 is coupled to the column such that the lowest part of the entire clamp/track assembly is elevated at least slightly above the upper surface of the plastic concrete surface.

Figure 17B:
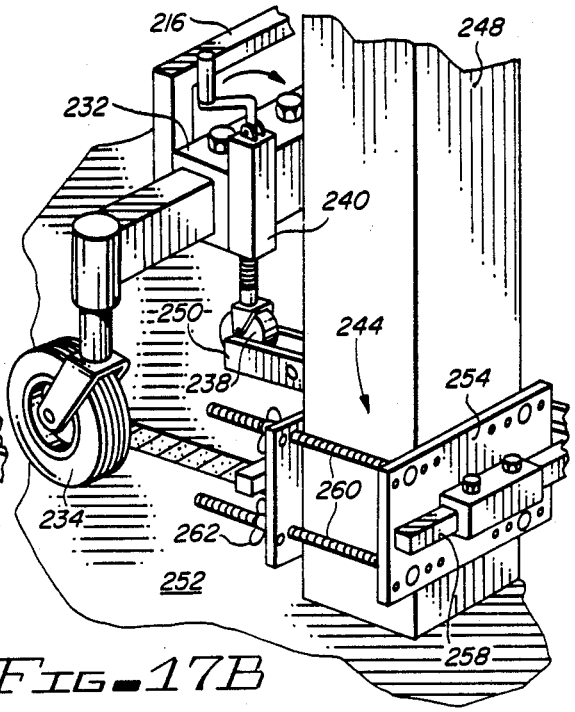

As column 248 is approached, the spreader is moved away from the end of bridge 206, hinge pin 229 is removed and gate section 224 is rotated into the retracted position illustrated in FIG. 19. Auxiliary stop 230 is bolted into place and the entire bridge assembly is translated closer toward column 248. FIG. 17B illustrates that the bridge assembly is then translated toward column 248 so that screw jack assembly 240 can be actuated to cause wheel 238 to engage track 250 and thereby elevate wheel 234 above surface 252 which had previously supported the weight of bridge span 216. Once the weight of span 216 is properly supported by track 250, the securing means of clamp 232 are loosened and the assembly comprising wheel 234 and wheel mounting bracket 236 is completely removed from span 216 as is depicted in FIG. 17C.

Figure 17C:
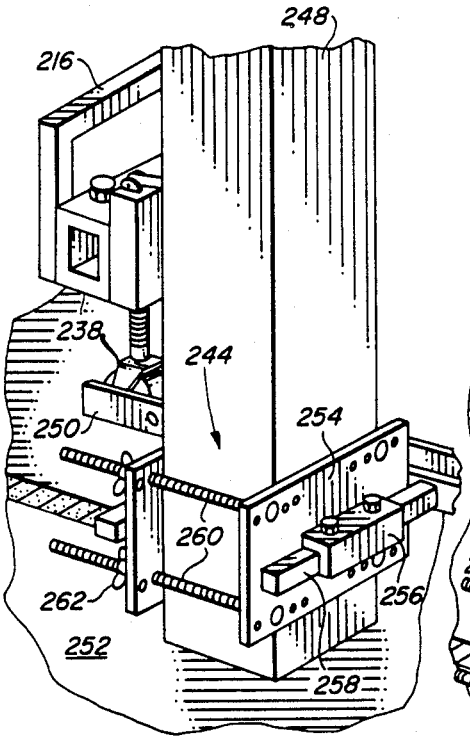
Figure 17D:
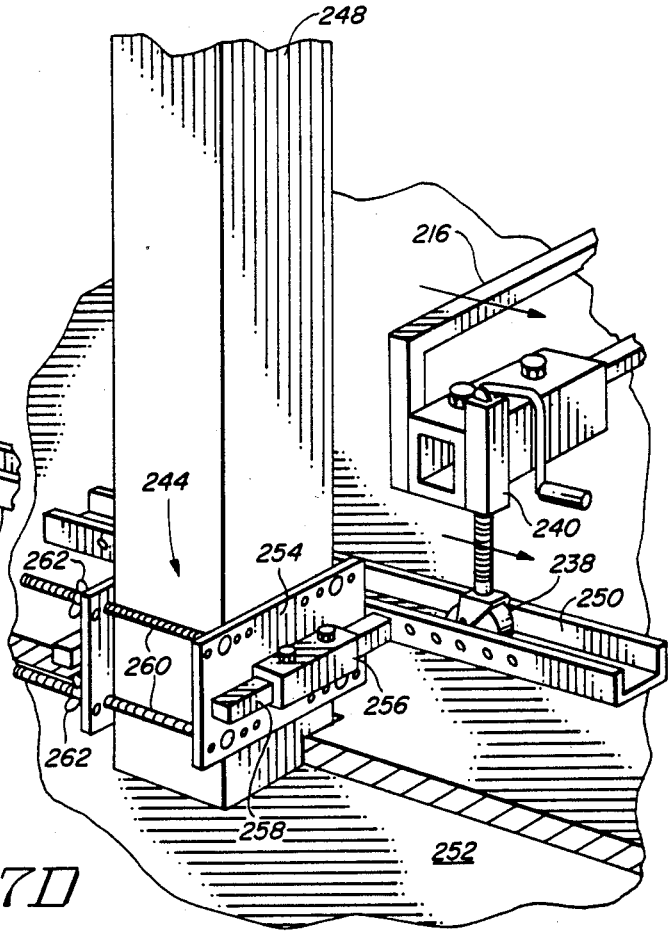

Depending on the relative positioning of columns 248, the operation depicted in FIGS. 17A–17C will take place either sequentially at one end of the bridge followed by the other end of the bridge, or will take place simultaneously when the columns are in paired, spaced apart alignment. In situations where only one side of the area to which topping material is to be applied includes vertically oriented obstructions, the procedures depicted in FIG. 17 will be accomplished for only a single end of bridge 206.

When the configuration depicted in FIG. 17C has been achieved, the bridge will be translated further along the length of the area of the plastic concrete until the spreader is properly aligned to dispense an additional layer of topping material. Bridge 206 can be translated back and forth along the entire length of track 250 as required. When bridge 206 is translated into the position illustrated in FIG. 17D, the assembly consisting of wheel 234 and wheel mounting bracket 236 is reinstated into clamp 232 and properly adjusted and secured. Jack screw assembly 240 is then actuated to transfer the weight from wheel 238 back to wheel 234. As bridge 206 is translated further along the length of plastic concrete, the procedure described immediately above is repeated to support the same end of span 214 above the concrete surface. Typically, with a track of the length and configuration depicted in FIG. 17, only a single span of bridge 206 will be supported by the clamp assembly/track at one time.

Although only a single embodiment of the improved material spreader system has been described, it would be readily apparent to one of ordinary skill in the art to produce a wide variety of structural modifications to this invention which would be equivalent to the invention described above. For example, a clamp assembly could be coupled to colum 248 at a point above the spans of bridge 206 and could be engaged by a second support assembly extending upward from the bridge. In another embodiment, translatable bridge support means in the form of a ceiling mounted crane could be coupled by a grouping of cables to bridge 206. When a vertical obstruction such as a column is approached as the ceiling mounted crane is translated along the length of the area of plastic concrete, the adjustable bridge means could be actuated to reduce the length of the bridge spans, permitting translation of spreader 200 over the reduced width section of the area of plastic concrete. Another readily apparent modification of the present invention involves substituting rollers for wheels 234 to permit the bridge means to be translated along and supported by the forms surrounding the area of plastic concrete.

The bridge disclosed in connection with the preferred embodiment of the present invention could also take many different forms other than the specific embodiment described above. Rather than having the pivotable gate sections which permit the span length of the bridge to be increased and decreased as desired, removable end sections, telescopic adjustment features for various other elements of the bridge spans or numerous other types of length adjustment devices could be incorporated into a bridge assembly and still fall within the scope of the present invention. Furthermore, a bridge assembly for supporting a translatable spreader may take the form of a single rail and the spreader could be coupled above, below or on both sides of that rail.

While the material spreader system has been described in connection with dispensing topping material onto a plastic concrete surface, the same invention could be used without modification to dispense a topping material onto a built up roof or onto any other surface which requires a topping or coating material but which cannot permit the wheels of a conventional spreader to contact the surface to be coated with topping material.

Accordingly, it is intended by the appended claims to cover all readily apparent modifications of the invention which fall within the broad scope of the material spreader invention. Referring now to FIGS. 22–30, yet another embodiment of the material spreader system of the present invention will be described in detail. This spreader system includes a spreader having a totally self-contained hydraulic system. In addition, the bridge of this embodiment of the material spreader system includes structure for readily adjusting the vertical spacing between the bridge and the surface of the plastic substance. The bridge also includes telescopically adjustable end sections for providing continuous adjustment of the overall bridge length.

Referring initially to FIGS. 22–25, one embodiment of a hydraulically powered material spreader system adapted to dispense a topping material over an area including a vertical obstruction is disclosed.

A material spreader 300 includes a material hopper 302 for storing a supply of topping material. A removeable hopper grate 304 includes a screen-like sieve for breaking clumps of topping material as the material is dispensed from a bag or other container into hopper 302. A bag cutting blade 306 may be secured as shown to grate 304 to assist in tearing open a bag of topping material.

The inclined sides of hopper 302 converge at the lower section of the hopper to form a widthwise slot of the type disclosed in detail in FIGS. 8 and 9. A gate 308 is fabricated from a cylindrical section and can be displaced between first and second positions to alternately cover and uncover the widthwise slot of the hopper. FIG. 24 illustrates that a hydraulic cylinder 310 is couled to an actuator arm 312 of gate 308. A threaded coupling in actuator arm 312 permits adjustment of the "open" position gate 308 to vary the rate of material dispensed from the hopper 302 as spreader 300 is translated back and forth across the bridge.

Spreader 300 includes a first pair of flange wheels 314 and a second pair of flanged wheels 315 which engage first and second spaced apart tracks or spans 316 and 318 of bridge 320.

Flanged wheels 314 are rigidly coupled together by a drive shaft 322 which is rotatably coupled to spreader 300 by a pair of spaced apart bearing assemblies, such as bearing assembly 324. Flanged wheels 315 are coupled together by second rigid shaft 326 which also serves as a finger agitator. Drive shaft/finger agitator 326 passes through the lower interior section of hopper 302 and serves to rigidly couple toghether the pair of spaced apart flanged wheels 315 and to act as a finger agitator to fluff up the particulate topping material stored within hopper 302.

Figure 25:
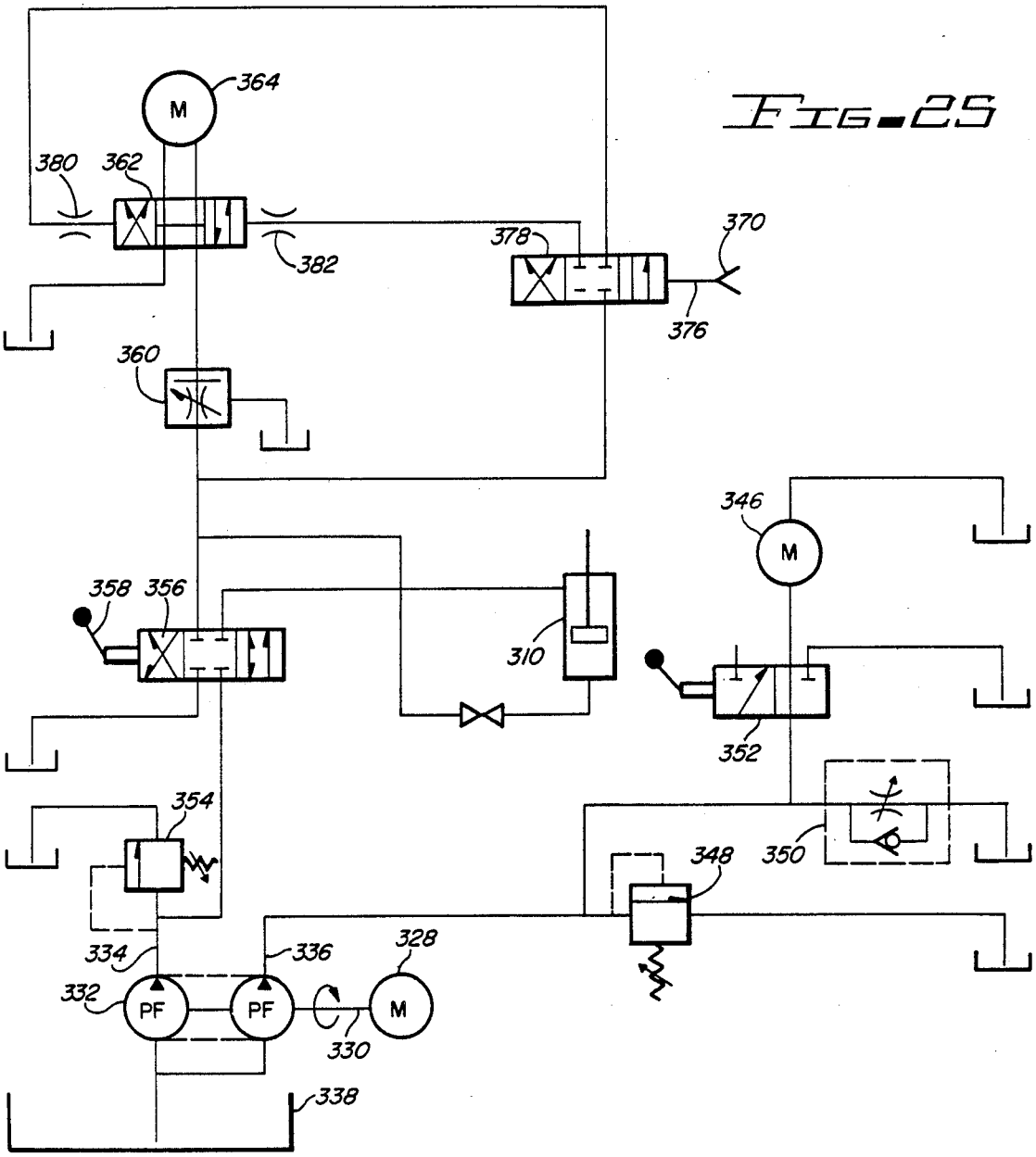
FIG. 25 is a schematic diagram of the hydraulic components of the hydraulically powered material spreader.

Referring now also to FIG. 25, energizing means such as a five horsepower gasoline engine 328 includes an output shaft 330 which is coupled to operate a vane double section hydraulic pump 332 of the type manufactured by the Sperry-Vickers Company. Pump 332 comprises part of an open loop hydraulic system and produces two independent pressurized fluid outputs designated by reference numbers 334 and 336. A hydraulic reservoir 338 serves as a source of hydraulic fluid which is used by the spreader hydraulic system. In FIG. 25, standard schematic diagram symbols have been utilized to show the specific configuration and coupling of each hydraulic component part of the hydraulic system of spreader 300. A throttle cable 340 permits the operating RPM of engine 328 to be controlled from a readily accessible location.

Figure 23:
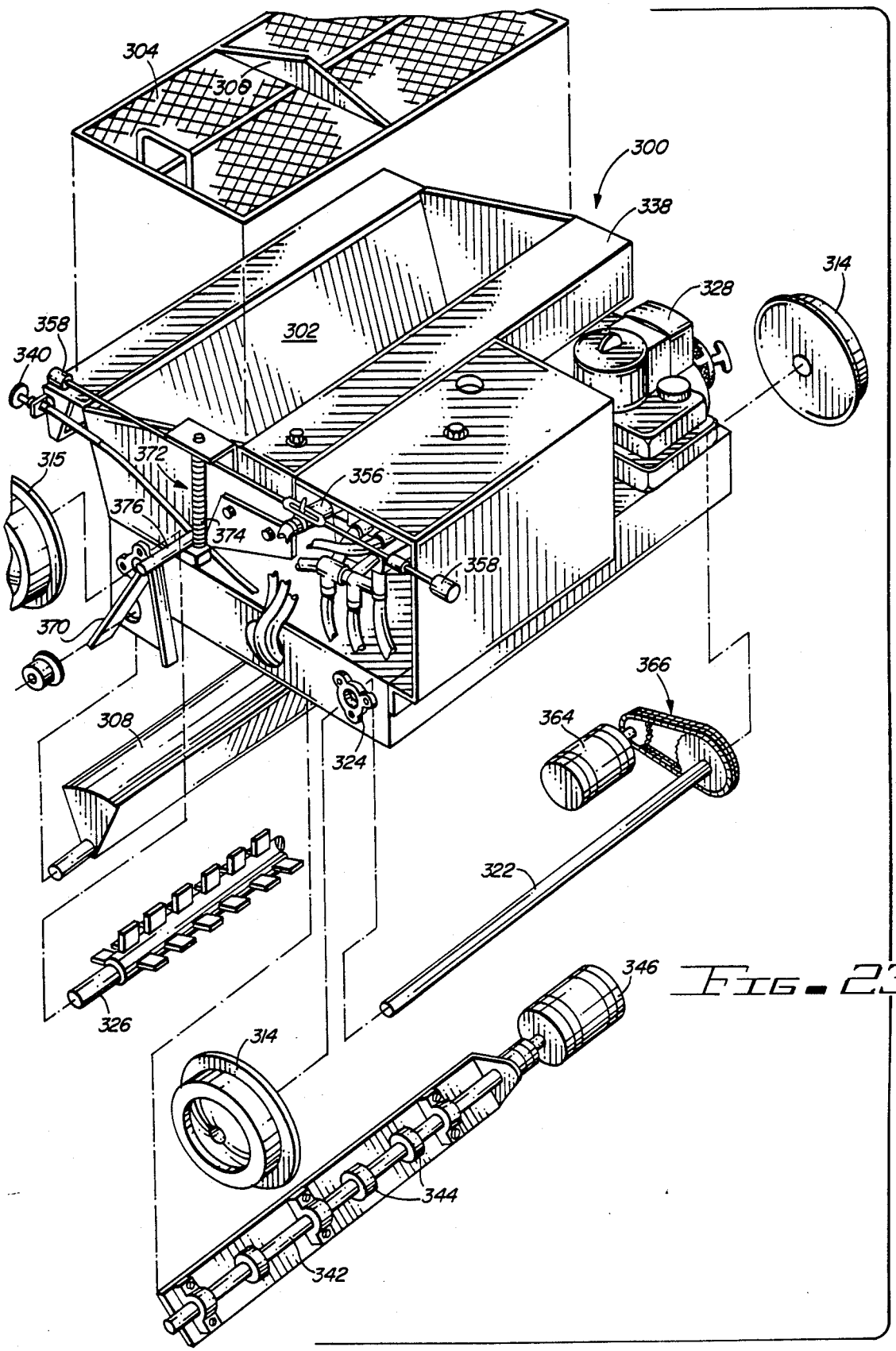
FIG. 23 is an exploded perspective view of the primary mechanical component parts of the hydraulically powered spreader.

The particulate contents of hopper 302 are vibrated by an eccentrically weighted vibrating element taking the form of a shaft 342 to which a plurality of spaced apart, eccentric weights 344 are rigidly secured as depicted in FIG. 23. The output shaft of a small hydraulic motor 346 is directly coupled to shaft 342. The entire vibration generating mechanism is coupled to the interior inclined hopper sidewall at a location analogous to the location of the vibration generating elements depicted in FIG. 8. FIG. 25 illustrates that output 336 of hydraulic pump 332 is coupled to a pressure relief valve 348, to a flow control valve 350, and to on/off valve 352. Flow control valve 350 can be adjusted to regulate the operating speed of hydraulic motor 346 to thereby control the intensity and frequency of the vibration imparted to the contents of hopper 302. Valve 352 either activates or deactivates hydraulic motor 346 to energize or deenergize the hopper vibrating system.

The second output 334 of hydraulic pump 332 is coupled to a pressure relief valve 334 and to an on/off valve 356. Valve 356 is actuated by actuator arm 358 (see FIG. 23) which can be conveniently reached by an operator standing at either side of spreader 300. When engine 328 is operating, displacement of valve 356 into the "on" position provides pressurized hydraulic fluid to hydraulic cylinder 310 for opening gate 308. Actuation of valve 356 into the "on" position also transmits pressurized hydraulic fluid through flow control valve 360 and forward/reverse valve 362 to motor 364. Motor 364 is coupled by a pair of sprockets and a drive chain designated by reference number 366 to rotate drive shaft 322.

Figure 22:
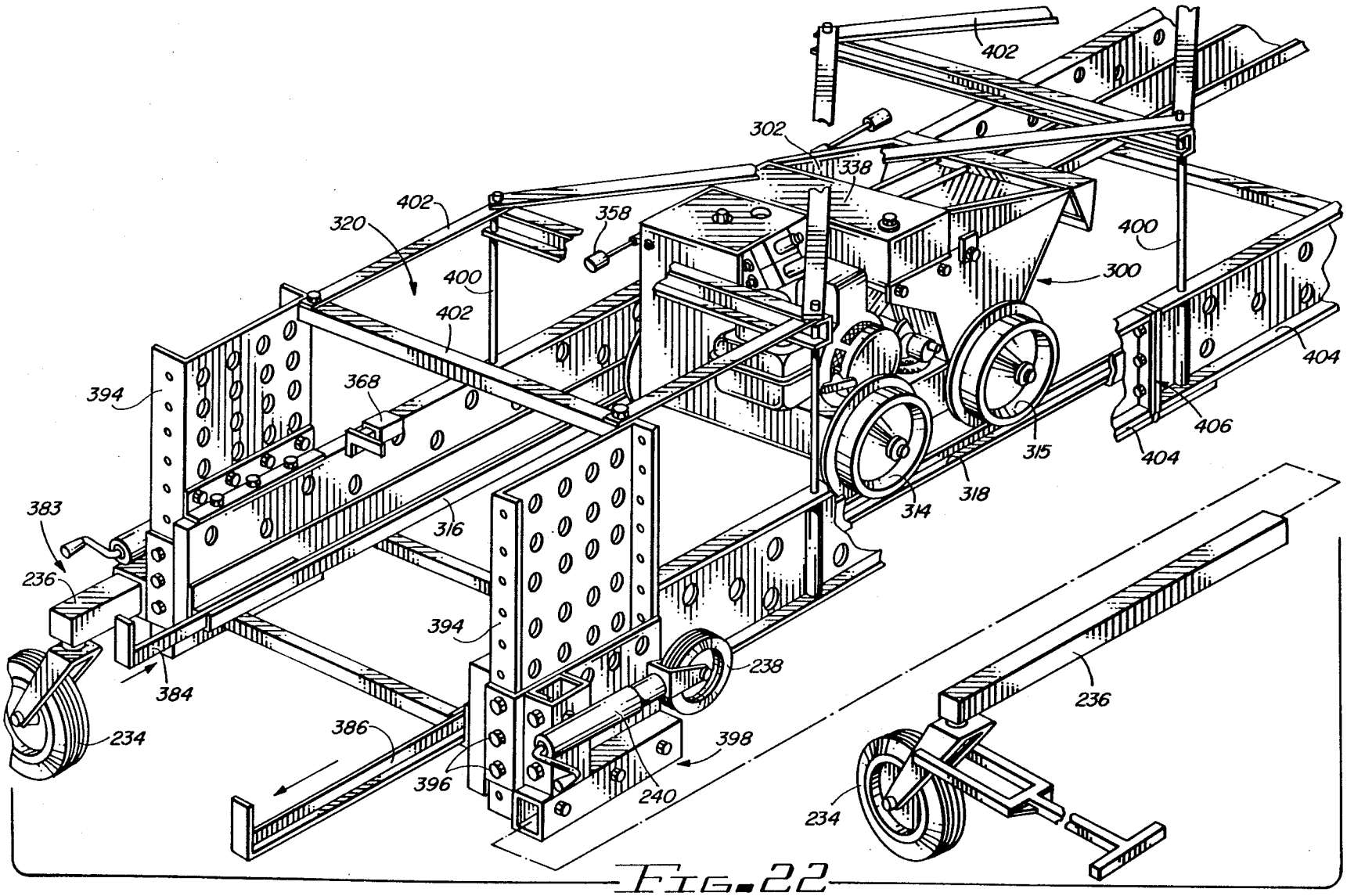
FIG. 22 is a partially cutaway perspective view illustrating yet another embodiment of the material spreader system of the present invention which includes a hydraulically powered spreader and continuously variable bridge length adjustment means.

Referring now to FIGS. 22, 23 and 25, sensing means is provided to sense the position of spreader 300 along the length of bridge 320 and to generate a reversing signal when spreader 300 arrives at a predetermined location along bridge 320. Reversing means is coupled to the sensing means and to hydraulic motor 364 for reversing the flow of hydraulic fluid through motor 364 in response to the reversing signal. The sensing means includes a reversing bracket 368 which is coupled to bridge 320 to permit engagement by reversing bracket engaging means in the form of a forked actuator arm 370. An overcenter locking device 372 includes a biasing spring 374 which maintain actuator arm 370 in either a first or second position until actuator arm 370 is displaced in to the opposite position by engaging a reversing bracket 368. The two arms of actuator arm assembly 370 are laterally offset along actuator arm shaft 376 so that actuator arm 370 will be engaged by only one specific reversing bracket 368. Typically a first reversing bracket 368 is coupled in proximity to one end of bridge 320, while a second reversing bracket 368 is coupled in proximity to the opposite end of bridge 320. The arms of these two reversing brackets 368 are laterally offset to engage a specific arm of forked actuator arm 370.

As illustrated in FIG. 25, the shaft 376 of actuator arm 370 is coupled to a pilot valve 378 which tranmits pressurized hydraulic fluid to either input port 380 or 382 of flow switching valve 362. The transmission of pressurized hydraulic fluid from pilot valve 378 to a specific one of the input ports 380 or 382 causes pressurized hydraulic fluid to flow through motor 364 in either a first or a second direction which determines whether spreader 300 is translated in either a first or a second direction across bridge 320.

When valve 356 is displaced into the "off" position, hydraulic cylinder 310 is deenergized, causing gate 308 to close and seal off the widthwise slot in the lower portion of hopper 302. The flow of hydraulic fluid to hydraulic motor 364 is also terminated and the movement of the spreader is stopped. Flow control valve 360 can be adjusted to vary the translation velocity of spreader 300 to assist in achieving a desired material distribution density.

Referring now to FIGS. 22, 26–28 and 30, the bridge length adjustment means which permits the material spreader system of the present invention to continue operating within a reduced width section will now be described in detail. Many of the reference numbers to be used in connection with the description of the structure disclosed in FIGS. 22, 26–28 and 30 have previously been used in connection with FIGS. 17 and 21 and indicate structural elements of the embodiment now under discussion which performs substantially identical functions as those elements described previously.

When the material spreader system of the present invention is being utilized to spread topping material over the full width section of a plastic surface, the first support means of the first and second bridge translation units (indicted by reference Nos. 234, 236, 238, 240 and 398) is utilized to contact a supporting surface lying outside of the area of plastic material for the purpose of supporting the bridge. This first support means 383 includes a pair of telescopically adjustable wheel mounting brackets 236 which are coupled to each end of the bridge and which each include a fully castering wheel 234. Wheel mounting brackets 236 are telescopically adjusted to an appropriate point and locked into position by a plurality of set bolts as discussed earlier.

Figure 29A:
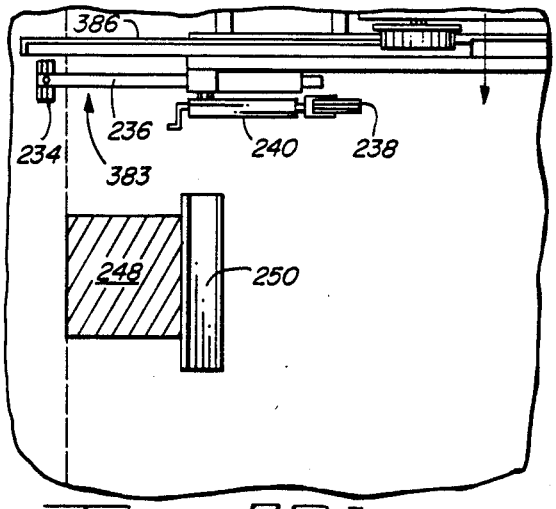
FIGS. 29A–F represent a series of views from above depicting the material spreader system as it is displaced past a vertically extending obstacle lying within the plastic surface area.
Figure 29D:
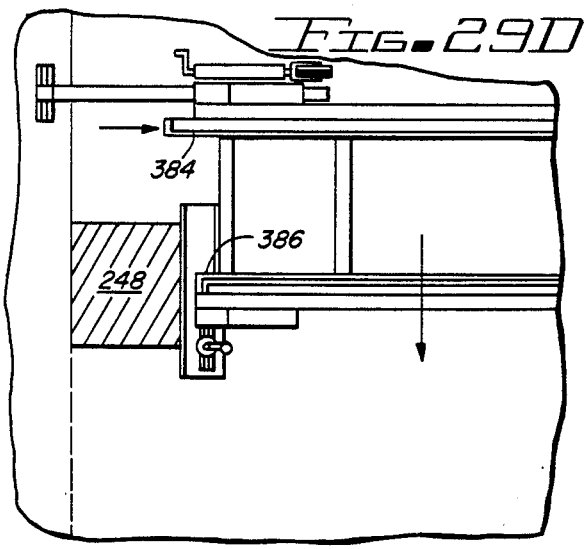
Figure 29B:
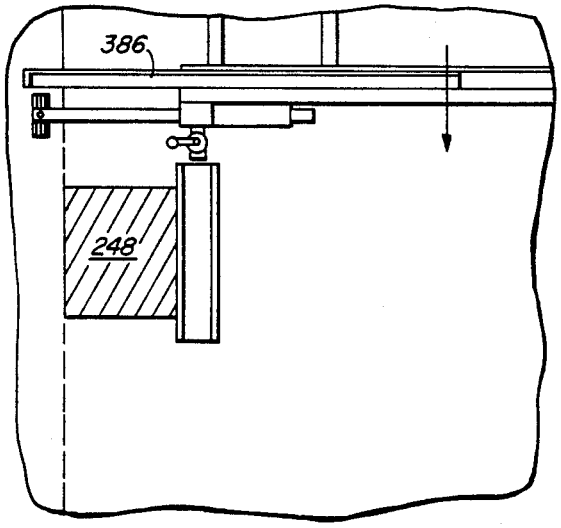
Figure 29E:
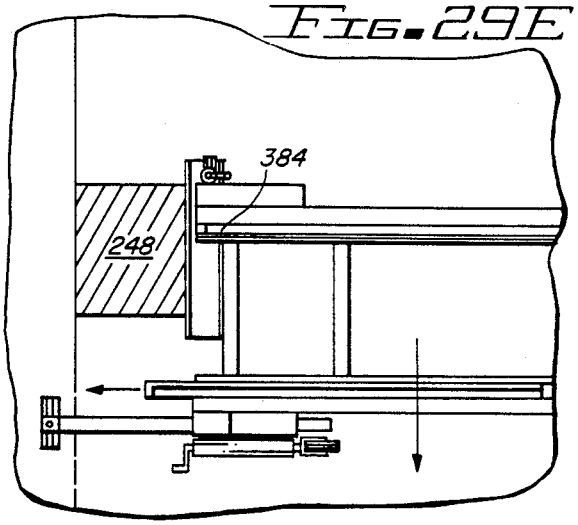
Figure 29C:
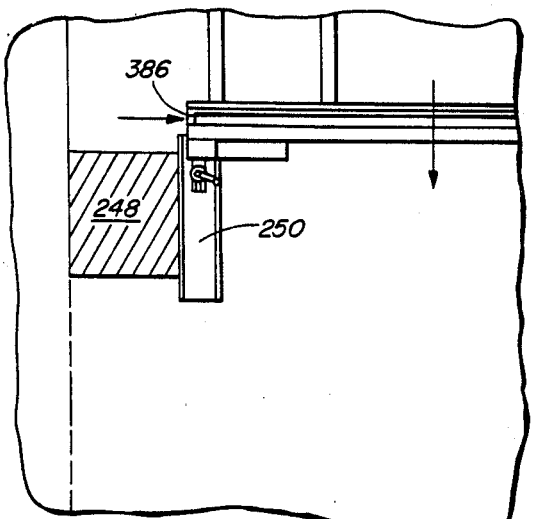
Figure 29F:
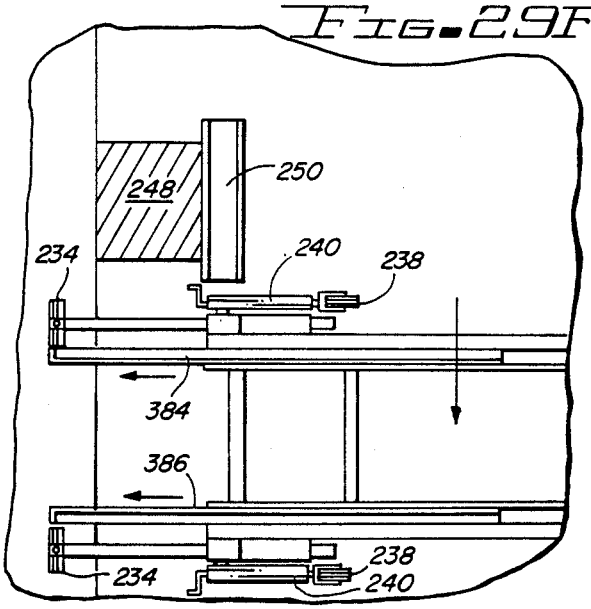
Figure 30A:
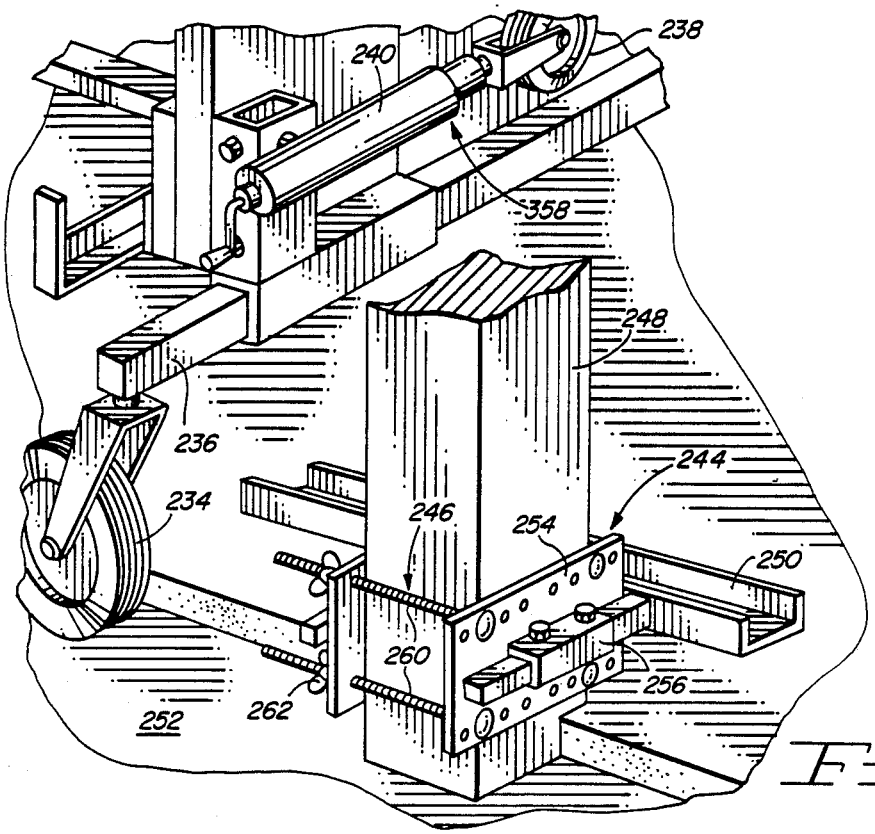
FIGS. 30A—B are partially cutaway perspective views particularly illustrating the manner in which the material spreader system bridge is translated past a vertically extending obstruction.
Figure 30B:
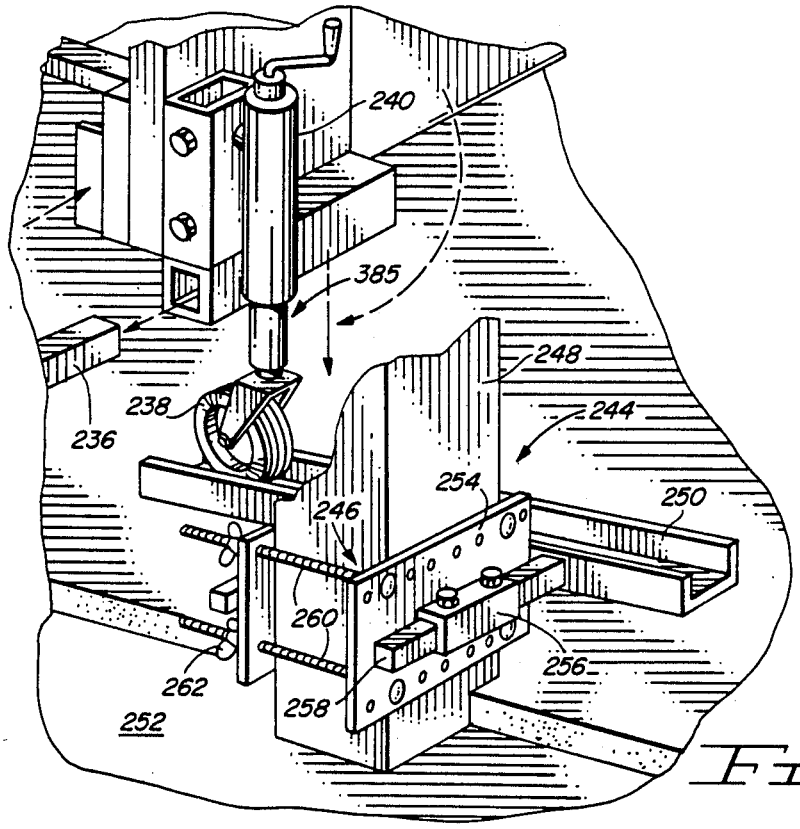

FIGS. 29 and 30 depict a detailed illustration of the manner in which second support means 385 which is coupled to each end of the bridge can be utilized to support one or both ends of the bridge can be utilized to support one or both ends of bridge 320 above the plastic surface as the bridge is laterally translated past a reduced width section of the plastic surface which includes a vertically oriented obstruction such as a column 248. Second support means 385 includes wheel 238, screw jack assembly 240 and roller support means indicated generally by reference No. 244. As discussed in detail above, roller support means 244 includes a clamp assembly 246 and a horizontally oriented track 250 which receive and support screw jack assembly 240. In the improved version of bridge 320 presently under discussion, screw jack assembly 240 is rotated into the horizontal position depicted in FIG. 30A when not in use and is rotated into the vertically oriented position depicted in FIG. 30B for the purpose of engaging track 250. When the weight of a selected portion of bridge 320 has been transferred to screw jack assembly 240, wheel mounting bracket 236 together with wheel 234 are removed from that segment of bridge 320.

The length of tracks 316 and 318 which support flanged wheel sets 314 and 315 of spreader 300 can be continuously varied by sliding the telescopically adjustable track section 384 and 386 either toward or away from the end of brige 320 as illustrated. FIGS. 26–28 depict the specific structural elements which are utilized to form track sections 384 and 386 and to permit telescopic adjustment of those track sections with respect to bridge 320. Each track section 316 and 318 includes a vertically oriented spreader stop bracket 388 which is coupled to a telescoping track element 390. A securing bracket is coupled to the side support element 393 of bridge 320 and supports track element 390 from below. A sufficient gap is maintained between the lower surface of track 316 and securing bracket 392 to permit track element 390 to be telescopically adjusted as required. Each end of bridge 320 includes telescopically adjustable track sections 384 and 386. These telescopic track sections are fabricated so that the overall length of bridge 320 can be adjusted to clear any vertically oriented obstructions of the type typically encountered.

FIGS. 29A–F sequentially depict the manner in which the weight of bridge 320 can be transferred from wheel 234 and wheel mounting bracket 236 to wheel 238 and screw jack assembly 240. FIGS. 29A and B depict track section 386 in the extended position, while FIGS. 29C and D depict track section 386 in the retracted position. FIG. 29F depicts the configuration of bridge 320 after it has been translated past vertically oriented obstruction 248. In this "normal" operating configuration, screw jack assemblies 240 have been rotated back into the horizontal or stored position, the weight of the depicted end of bridge 320 is being supported by wheels 234 and track sections 384 and 386 have been telescopically extended on an appropriate length to permit spreader 300 to dispense topping material right up to the edge of the plastic concrete surface.

Referring now to FIG. 22, means for varying the vertical separation between bridge 320 and the surface of the plastic substance will now be described in detail. A pair of vertically oriented end plates 394 are coupled to each end of bridge 320. A single bridge translation unit which includes wheel 234, wheel mounting bracket 236, wheel 238 and screw jack assembly 240, is coupled to one of the two end plates 394. By removing the grouping of three securing devices designated by reference number 396 from both the front and back surfaces of each translation unit mounting bracket 398, bracket 398 can be vertically adjusted with respect to end plate 394 and coupled at any given elevation to bracket 394. Adjustment of all four mounting brackets 398 of bridge 320 permits the overall elevation of bridge 320 to be controlled as desied to thereby vary the vertical separation between spreader 300 and the surface of the plastic substance on which topping material is to be distributed. Any one of a number of different variables may dictate that spreader 300 be either closer to or further away from the surface of the plastic substance to achieve optimum material distribution onto that plastic surface.

The vertically oriented support arms 400 and the various lengths of cross bracing 402 provide extra support and rigidity to bridge 320. The entire bridge assembly is bolted together and can be readily disassembled for storage or transportation to another job site. The side sections 404 of bridge 320 are fabricated in sections and are joined together by securing means as is indicated by reference number 406.

It can now be seen that the spreader disclosed above which includes a totally self-contained hydraulic system operates automatically to repeatedly traverse bridge 320 for the purpose of distributing topping material onto a plastic surface. In order to achieve the most uniform possible distribution, spreader 300 typically traverse bridge 320 approximately four or more times before bridge 320 is laterally displaced along the length of the plastic surface. After the desired number of passes has been completed by spreader 300, the spreader operator actuates arm 358 which deenergizes spreader drive motor 364 and closes gate 308. Bridge 320 is then laterally displaced a distance approximately equal to the length of the widthwise slot in the hopper 302.

It will be apparent to those skilled in the art that the materials spreader system disclosed above may be modified in numerous ways and may assume many embodiments other than the preferred forms specifically set out and described above. For example, many different hydraulic system configurations could be utilized to achieve substantially the same result that is achieved by using the specific configuration of hydraulic components disclosed above. In addition, totally different means for reversing the direction of travel of the spreader could readily be adapted to operate with the specific embodiment of the invention disclosed above and would be obvious to one of ordinary skill in the art. Numerous other types of modifications would be readily apparent to one skilled in the art. Accordingly it is intended by the appended claims to cover all such modifications of the invention which fall within the broad scope of the material spreader invention disclosed above.

Figure 31:
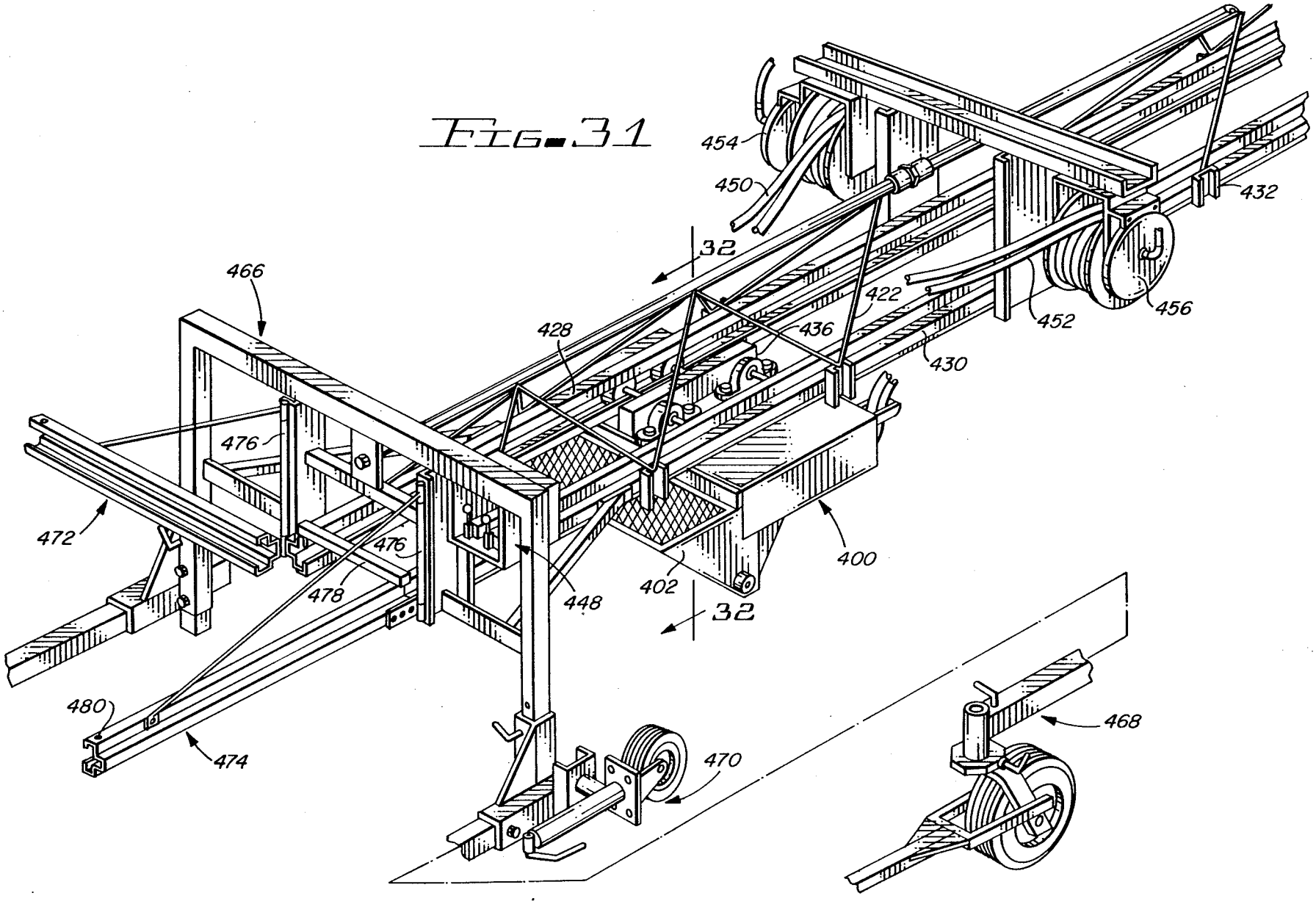
FIG. 31 depicts a pneumatic powered embodiment of a material spreader system including a bridge fabricated from a concrete screed frame and having collapsible end sections.
Figure 32:
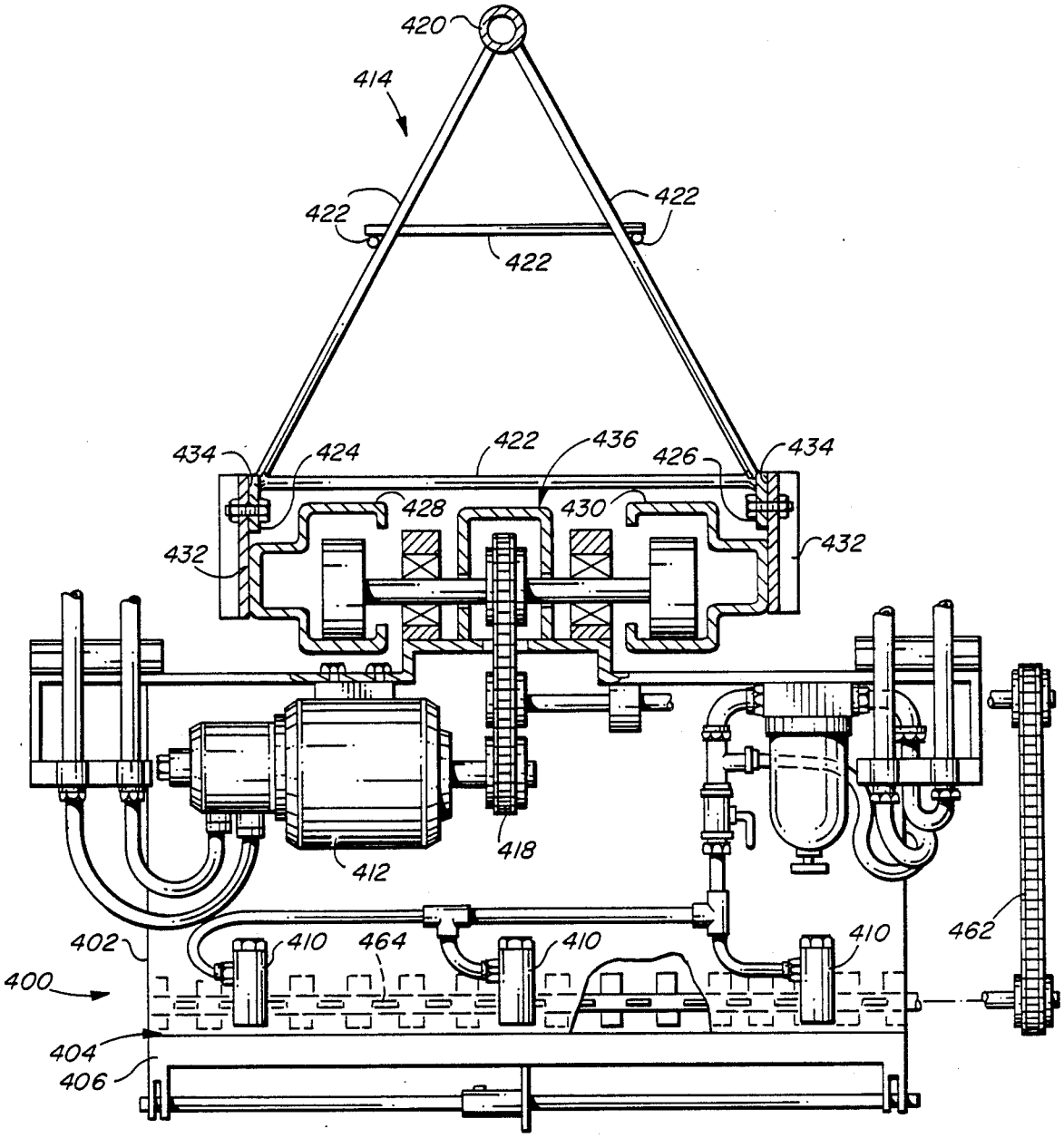
FIG. 32 is a sectional view of the material spreader system depicted in FIG. 31, taken along section line 32—32.
Figure 33:
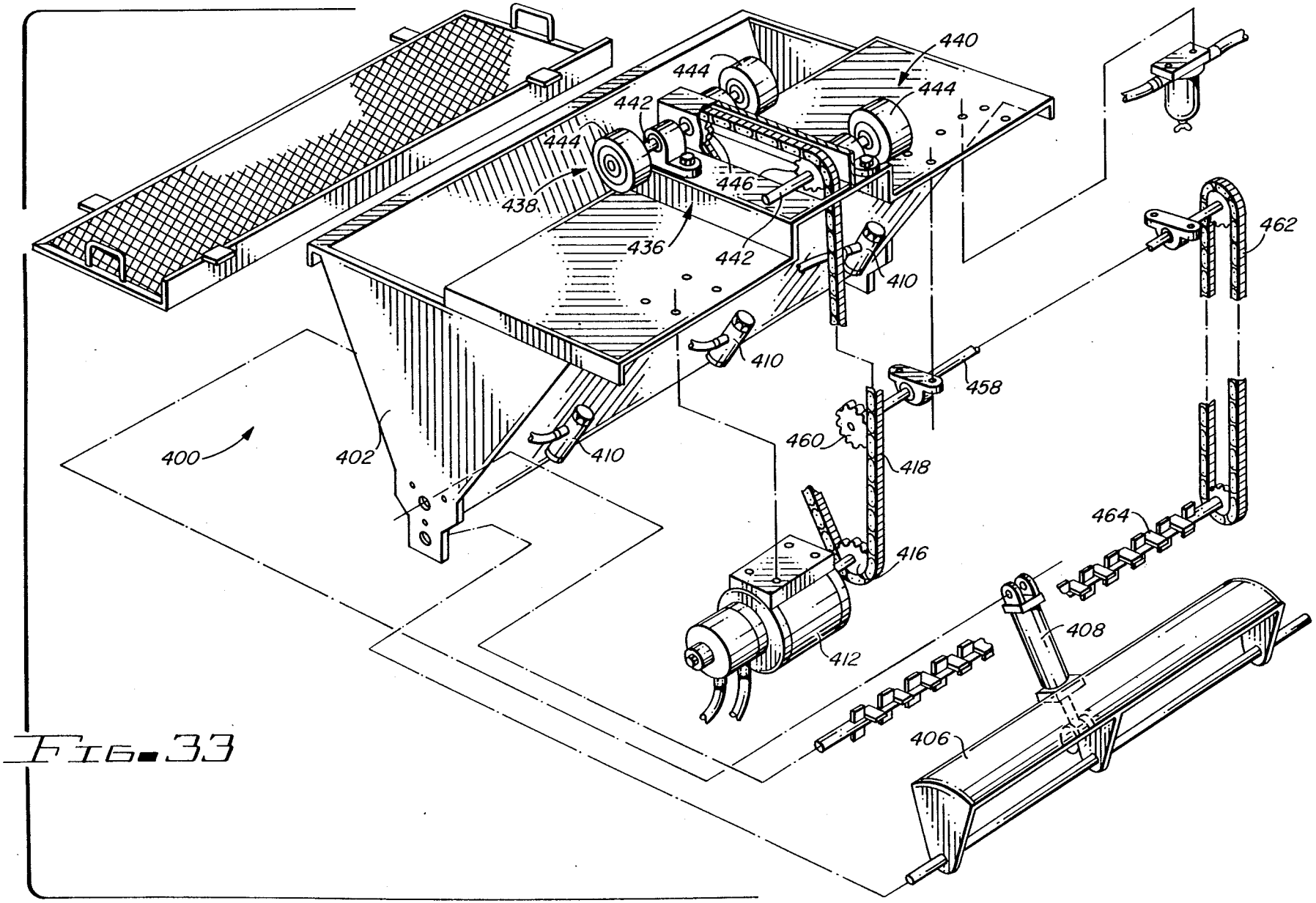
FIG. 33 is an exploded perspective view of the pneumatically powered spreader depicted in FIG. 31.

Referring now to FIGS. 31, 32 and 33, yet another embodiment of the material spreader system of the present invention will be described in detail. Spreader 400 of this version of the material spreader system is structurally quite closely related to spreader 24 depicted in FIGS. 1 and 2 and to spreader 124 depicted in FIGS. 7, 8, 9, 11 and 12. Spreader 400 includes a hopper 402 having an elongated slot 404 which is selectively exposed by a clam shell gate mechanism 406. A pneumatically powered actuator 408 displaces gate 406 between an "open" and a "closed" position. A plurality of three pneumatically powered vibrators 410 are coupled to an inclined side wall of hopper 402 for the purpose of forming a vibrating particulate feed surface.

Drive means in the form of a pneumatically powered motor 412 is coupled to spreader 400 for the purpose of translating the spreader back and forth along the length of bridge means 414. The output shaft of motor 412 is coupled to a drive sprocket 416 which engages a drive chain 418.

In this particular embodiment of the invention, bridge means 414 is fabricated from a standard, commercially available open support frame of the type typically used in connection with a triangular truss concrete screed. A suitable screed frame is available from the Allen Engineering Corporation of Paragould, Arkansas. The triangular truss frame includes a generally triangular cross section having an upper apex formed from a top support member 420. The sides and base of the triangular frame are defined by a plurality of truss members designated generally by reference number 422 in FIG. 32. The intersection of the sides and base of the triangular frame further define first and second edges designated by reference numbers 424 and 426. First and second spreader support rails designated by reference numbers 428 and 430 are coupled by a plurality of mounting brackets 432 to frame mounting brackets designated by reference number 434. When the triangular truss frame is used as a screed, frame mounting brackets 434 are utilized to couple front and rear screed blades to the screed. In the material spreader system embodiment depicted in FIGS. 31, 32 and 33, frame mounting brackets 434 couple the triangular truss frame to the remaining elements of bridge means 414.

A roller assembly 436 includes first and second spaced apart trucks 438 and 440. Each truck includes an axle 442 and first and second wheels 444. Wheels 444 are rigidly coupled to axles 442. The central section of each axle 442 includes a drive sprocket 446. Displacement of drive chain 418 caused by rotation of motor 412 rotates drive sprockets 446, axles 442 and wheels 444. Actuation of motor 412 in either a forward or a reverse direction thereby causes either forward or reverse translation of spreader 400 with respect to bridge means 414. The speed and direction of operation of motor 412 is controlled in the manner described above in connection with FIGS. 1–12. The pneumatic flow diagram depicted in FIG. 12 shows the manner in which a supply of pressurized air is transmitted to the various pneumatically powered operating elements of spreader 400. FIG. 31 illustrates that the motor throttle valve and gate control valve are positioned within a control box 448. It is apparent that the control valves shown depicted within control box 448 could readily be included within spreader 400 and actuated by radio waves or optical signals manually or automatically actuated by position sensing means to permit operator control of the spreader from a position outside of the wet concrete surface area.

Spreader 400 is provided with a supply of compressed air by two sets of paired air hoses 450 and 452 and by associated spring biased hose supply reels 454 and 456 in a manner similar to that described above in connection with the material spreader system depicted in FIG. 13.

An idler shaft 458 includes a drive sprocket 460 which is rotated by displacements of drive chain 418. Rotation of idler shaft 458 causes displacement of a second drive chain 462 which is coupled to rotate finger agitator 464.

Translatable bridge support means in the form of wheeled translation unit 466 is coupled to each end of bridge means 414. The structure and function of primary wheel unit 468 and secondary wheel unit 470 is substantially the same as that described earlier in connection with FIGS. 17A–B, 21, 22, 29A–D and 30A–B.

Bridge means 414 further includes swinging end sections 472 and 474 which are coupled by a hinge 476 to translation unit 466. When the material spreader system is being translated past a vertically oriented obstruction such as a warehouse column, end sections 472 and 474 are placed in the retracted position designated by reference number 472. A stop bracket 478 includes a horizontally oriented coupling bar and two locking pins which extend vertically downward. The two locking pins of stop bracket 478 are inserted into apertures in the upper surface of the ends of support rails 428 and 430 and limit the maximum displacement of spreader 400 with respect to bridge means 414. When end sections 472 and 474 are moved into the extended position designated by reference number 474, stop bracket 478 is inserted into the apertures designated by reference number 480. In this configuration, stop bracket 478 not only limits maximum displacement of spreader 400 with respect to bridge 414, but also maintains end section 472 and 474 locked in the extended position.

It will be readily apparent to those skilled in the art that the material spreader system disclosed above may be modified in numerous ways and may assume many embodiments other than the preferred forms specifically set out and described above. For example, bridge means 414 could include a third, centrally located, slightly elevated third guide rail for the purpose of supporting a second single roller truck. In this configuration, roller assembly 436 would include only three wheels but would operate in substantially the same manner as that described above. In addition, bridge means 414 could take the form of a vertically oriented I-beam and the roller assembly coupled to spreader 400 could include a plurality of spaced apart trucks which contact the side surfaces of the I-beam as well as the upper surface of the lower section of the I-beam. In this I-beam bridge configuration, the vertical spacing between the wheels of the roller assembly would prevent side to side swaying movement of spreader 400 while the weight of spreader 400 would be supported by the lowermost wheels of the roller assembly which would contact the lower, horizontally oriented surface of the I-beam. Numerous other modifications would be readily apparent to one skilled in the art. Accordingly, it is intended by the appended claims to cover all such modifications of the invention which fall within the broad scope of the material spreader invention disclosed above.

I claim:

1. Apparatus for spreading a uniform blanket of topping material onto a surface of plastic material having a length and width, said apparatus comprising:

a. a spreader including a hopper for storing a supply of loose topping material and for dispensing a stream of topping material from an elongated slot in said hopper as said spreader is translated back and forth along a path;

b. bridge means supported above and spanning the width of the plastic surface without contacting the plastic surface and translatable along the length of the plastic surface for providing an elevated path to translate said spreader across a widthwise segment of the plastic surface and for maintaining said spreader vertically spaced above and separated from the plastic surface, said bridge means including guide means for confining said spreader to a fixed path with respect to said bridge means as said spreader is translated back and forth across said bridge means;

c. meand coupled to said spreader and extending along the entire length of said elongated slot for metering the discharge of topping material from said hopper at a rate proportional to the translation velocity of said spreader across said bridge means and independent of the vertical spacing between said slot and the plastic surface, said metering means including a gate displaceable between open and closed positions and gate actuator means coupled to said gate for displacing said gate between the open and closed positions;

d. means for agitating the topping material within said hopper and in proximity to said elongated slot;

e. means coupled to said spreader for vibrating said hopper to maintain a uniform flow of topping material through said elongated slot as said spreader is translated back and forth across said bridge means;

f. drive means coupled to said spreader for translating said spreader back and forth across said bridge means; and g. control means coupled to said drive means for controlling the back and forth translation of said spreader along said bridge means and coupled to said vibrating means and to said gate actuator means for energizing said vibration means and displacing said gate into the open position when said drive means is energized;

whereby sequential translations of said spreader across said bridge means followed by sequential translations of said bridge means along the length of the plastic surface covers the entire surface with a uniform blanket of topping material.

2. Apparatus for spreading a uniform blanket of topping material onto a surface of a plastic material having a length and a width, said apparatus comprising:

a. a spreader having a hopper for storing a supply of loose topping material and for dispensing a stream of topping material from an elongated slot in said hopper as said spreader is translated back and forth along a path, said spreader including a roller assembly having first and second spaced apart trucks, said hopper including first and second opposing, inclined walls having parallel oriented, adjacent lower surfaces which converge together to form said elongated slot;

b. bridge means spanning the width of the plastic surface without contacting the plastic surface and translatable along the length of the plastic surface for providing an elevated path to support the roller assembly of said spreader and to permit translation of said spreader across a widthwise segment of the plastic surface while maintaining said spreader vertically spaced above and separated from the plastic surface, said bridge means including guide means engaging said roller assembly to confine said spreader to a fixed path with respect to said bridge means as said spreader is translated back and forth across said bridge means;

c. means coupled to said spreader and engaging said elongated slot for metering the discharge of topping material from said hopper at a rate proportional to the translation velocity of said spreader across said bridge means and independent of the vertical spacing between said slot and the plastic surface, said metering means including a gate displaceable between a closed position where said gate contacts the lower surfaces of said first and second walls to seal off said elongated slot to prevent the flow of topping material from said hopper and an open position where said gate contacts only the lower surface of said second wall to permit topping material to be metered from said hopper through said elongated slot;

d. means for agitating the topping material within said hopper and in proximity to said elongated slot;

e. means coupled to the first wall of said hopper for vibrating said hopper to assist in maintaining a uniform flow of topping material through said elongated slot as said spreader is translated back and forth across said bridge means, said vibrating means including a rotary shaft having a plurality of spaced apart eccentric weights and means for rotating said shaft;

f. drive means coupled to said spreader for translating said spreader back and forth across said bridge means; and g. control means coupled to said drive means for controlling the back and forth translation of said spreader along said bridge means;

whereby sequential translations of said spreader across said bridge means followed by sequential translations of said bridge means along the length of the plastic surface covers the entire surface with a uniform blanket of topping material.

3. Apparatus for spreading a uniform blanket of topping material onto a surface of plastic material having a length and a width, said apparatus comprising:

a. a spreader including a roller assembly having first and second spaced apart wheeled trucks for supporting said spreader and for enabling said spreader to be translated along a linear path;

b. a hopper forming a part of said spreader for storing a supply of loose particulate topping material and for dispensing a widthwise stream of the topping material from an elongated rectangular slot in said hopper as said spreader is translated back and forth along the path, said hopper including i. first and second converging end surfaces having parallel oriented lower edges which define first and second opposing sides of said slot;

ii. first and second side surfaces rigidly coupled to said first and second end surfaces and having parallel oriented lower edges which define third and fourth opposing sides of said slot where the first, second, third and fourth sides of said slot lie within a single plane;

iii. vibrator means coupled to said first end surface for inducing substantially constant amplitude and substantially constant frequency vibrations in said first end surface and for transmitting said vibrations through said first and second side surfaces to induce vibrations in said second end surface to thereby induce vibrations in the particulate topping material in contact with the vibrating first and second end surfaces and the first and second side surfaces of said hoper to provide a uniform, uninterrupted flow of topping material along the entire length of said elongated rectangular slot;

c. flow control means coupled to said hopper and spanning the length of said slot for dispensing a continuous widthwise stream of topping material from said slot at a rate unrelated to the vertical spacing between said slot and the underlying plastic surface, said flow control means including rotating metering means positioned in proximity to, oriented parallel to and centered about said slot for metering the flow of topping material through said slot;

d. bridge means spanning the width of the plastic surface without contacting the plastic surface and translatable along the length of the plastic surface for providing an elevated path to support the roller assembly of said spreader and to permit translation of said spreader across a widthwise segment of the plastic surface while maintaining said spreader vertically spaced above and separated from the plastic surface, said bridge means including i. guide means for engaging said roller assembly to confine said spreader to a fixed path with respect to said bridge means as said spreader is translated back and forth across said bridge means;

ii. a primary support element formed from an open support frame having first and second ends;

iii. translatable bridge support means coupled to the first and second ends of said primary support element for enabling said bridge means to be translated along the entire length of said plastic surface, said bridge support means including a first translation unit coupled to the first end of said primary support element and a second translation unit coupled to the second end of said primary support element;

e. rotary drive means coupled to said roller assembly at a first position on said spreader for translating said spreader back and forth across said bridge means and coupled to said flow control means at a second position on said spreader spaced apart from the first position for rotating said rotating metering means; and f. spreader control means coupled to said rotary drive means and to said flow control means for selectively energizing and deenergizing said rotary drive means and said flow control means;

whereby sequential translations of said spreader across said bridge means followed by sequential translations of said bridge means along the length of the plastic surface covers the entire surface with a uniform blanket of topping material.

4. The apparatus of claim 3 wherein said first and second trucks each include at least two non-steerable wheels for directing said spreader in a straight line.

5. The apparatus of claim 3 wherein said rotary drive means includes:

a. a first motor for rotating said rotating metering means; and b. a second motor for energizing said vibrator means.

6. The apparatus of claim 3 further including reversing means for reversing the direction of travel of said spreader when said spreader reaches a predetermined position on said bridge means.

7. The apparatus of claim 3 wherein said rotary drive means forms a part of said spreader.

8. The apparatus of claim 3 wherein said rotating metering means includes vaned metering means having a first end penetrating through the first side surface of said hopper and wherein said rotary drive means is coupled to the first end of said vaned metering means at a location outboard of said hopper.

9. The apparatus of claim 8 wherein said vaned metering means includes:

a. a shaft having a centrally located axis of rotation; and b. a plurality of vanes coupled to said shaft at radially spaced apart intervals.

10. The apparatus of claim 8 wherein said spreader control means energizes and deenergizes said vibrator means.

11. The apparatus of claim 8 wherein said rectangular slot is positioned within a horizontal plane.

12. The apparatus of claim 8 wherein said flow control means includes slot engagement means disposed below said slot and including:

a. a shaft rotationally coupled to said spreader disposed below and centered about said slot;

b. a slot engagement surface coupled to said shaft and engaging said slot from below; and c. means coupled to said slot engagement means for rotationally displacing said shaft and said slot engagement surface.

13. The apparatus of claim 12 wherein at least a part of said slot engagement means is formed in the shape of a section of the wall of a cylindrical surface.

14. The apparatus of claim 8 wherein said primary support element has a generally triangular cross sectional shape and incorporates a load bearing base having first and second edges.

15. The apparatus of claim 14 wherein said guide means further includes a first guide rail coupled to the first edge of said load bearing base.

16. The apparatus of claim 8 wherein said vibrator means includes at least three vibration generating elements coupled to said first end surface at uniformly spaced apart intervals.

17. The apparatus of claim 16 wherein each of said vibrating elements is coupled to said first end surface of said hopper at an equal distance above said slot.

18. The apparatus of claim 8 wherein said primary support element includes:

a. a horizontally oriented, load bearing base;

b. a horizontally oriented apex spaced apart from said base and oriented parallel to said base; and c. a plurality of struts extending between the base and the apex which define first and second sides of the primary support element.

19. The apparatus of claim 18 wherein said guide means is coupled to the load bearing base of said primary support element and includes a linear, vertically oriented surface for engaging and guiding the roller assembly of said spreader.

20. The apparatus of claim 18 wherein the apex of said primary support element is disposed below said base.

* * * * *